US008064814B2

(12) United States Patent
Kagawa

(10) Patent No.: US 8,064,814 B2
(45) Date of Patent: Nov. 22, 2011

(54) FIXING APPARATUS AND IMAGE FORMING APPARATUS

(75) Inventor: Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 202 days.

(21) Appl. No.: 12/545,151

(22) Filed: Aug. 21, 2009

(65) Prior Publication Data

US 2010/0061778 A1 Mar. 11, 2010

(30) Foreign Application Priority Data

Sep. 5, 2008 (JP) ..... 2008-228650

(51) Int. Cl.
*G03G 15/20* (2006.01)

(52) U.S. Cl. ..... 399/327; 399/328

(58) Field of Classification Search ..... 399/320, 399/326, 327, 328, 329, 330; 219/216
See application file for complete search history.

(56) References Cited

U.S. PATENT DOCUMENTS

| | | | | |
|---|---|---|---|---|
| 4,165,965 | A | 8/1979 | Bernardelli et al. | |
| 6,553,204 | B1 * | 4/2003 | Yamada | 399/328 |
| 6,594,464 | B2 * | 7/2003 | Hayashi et al. | 399/325 |
| 2007/0189817 | A1 | 8/2007 | Kagawa | |
| 2007/0212094 | A1 | 9/2007 | Asakura et al. | |
| 2008/0124144 | A1 | 5/2008 | Mukai et al. | |

FOREIGN PATENT DOCUMENTS

| | | | | |
|---|---|---|---|---|
| CN | 101192041 | A | | 6/2008 |
| JP | 53-010437 | | | 1/1978 |
| JP | 61162074 | A | * | 7/1986 |
| JP | 05224542 | A | * | 9/1993 |
| JP | 07-302012 | A | | 11/1995 |
| JP | 09-269693 | | | 10/1997 |
| JP | 2000-066541 | A | | 3/2000 |
| JP | 2002278319 | A | * | 9/2002 |
| JP | 2003-337495 | A | | 11/2003 |
| JP | 2005-070602 | A | | 3/2005 |
| JP | 2005091667 | A | * | 4/2005 |
| JP | 2005-181567 | A | | 7/2005 |
| JP | 2005-234190 | | | 9/2005 |
| JP | 2005-309010 | A | | 11/2005 |
| JP | 2006030746 | A | * | 2/2006 |
| JP | 2006-154540 | A | | 6/2006 |
| JP | 2007-212896 | | | 8/2007 |
| JP | 2007-241180 | A | | 9/2007 |
| JP | 2007-279344 | | | 10/2007 |

* cited by examiner

*Primary Examiner* — Robert Beatty
(74) *Attorney, Agent, or Firm* — Renner, Otto, Boisselle & Sklar, LLP

(57) ABSTRACT

Provided is a fixing apparatus employing an external heating method in which a scratch on a belt member and slippage of the belt member are prevented. The fixing apparatus includes: a fixing roller; a pressure member pressed against the fixing roller; an endless belt which is rotatably supported and contacts the fixing roller surface for heating the fixing roller; and heating means for heating the endless belt. By passing a recording material through a nip between the fixing roller and the pressure member, the fixing apparatus fixes an unfixed toner image on the recording material on which the unfixed toner image is transferred. The fixing apparatus further includes a cleaning member for removing dirt adhered to a surface of the endless belt by contacting the surface of the endless belt in a region where the endless belt is not supported.

14 Claims, 9 Drawing Sheets

FIG. 13

| | Example 1 (Fig. 4) | | Example 2 (Fig. 7) | | Example 3 (Fig. 8) | | Example 4 (Fig. 9) | | Comparative Example (Fig. 10) | |
|---|---|---|---|---|---|---|---|---|---|---|
| Contacting direction of scraper (Contacting angle) | Counter direction (150°) | | With direction (30°) | | Counter direction (150°) | | Counter direction (150°) | | Counter direction (150°) | |
| Contacting section where external heating belt contacts scraper | Between heating rollers | | Between heating rollers | | Between heating rollers | | Between heating rollers | | On heating roller | |
| Shape of scraper (Pushed amount) | Bent at one position (0.6 mm) | | Bent at one position (0.6 mm) | | Bent at two positions (0.6 mm) | | Bent at one position + Bent at two positions (0.3 mm + 0.6 mm) | | Bent at one position (0 mm) | |
| Cleaning performance | Spotted (sheet(s)) | Missing | Spotted (sheet(s)) | Missing | Spotted (sheet(s)) | Missing | Spotted (sheet(s)) | Missing | Spotted (sheet(s)) | Missing |
| 0 to 20K | 0 | Excellent | 0 | Excellent | 0 | Excellent | 0 | Excellent | 35 | Moderate |
| 20 to 40K | 0 | Excellent | 0 | Satisfactory | 0 | Excellent | 0 | Excellent | 62 | Moderate |
| 40 to 60K | 0 | Excellent | 5 | Satisfactory | 0 | Excellent | 0 | Excellent | 105 | Poor |
| 60 to 80K | 0 | Satisfactory | 12 | Moderate | 0 | Excellent | 0 | Excellent | 220 | Poor |
| 80 to 100K | 0 | Satisfactory | 23 | Moderate | 0 | Excellent | 0 | Excellent | 235 | Poor |
| 100 to 120K | 0 | Moderate | 40 | Moderate | 0 | Satisfactory | 0 | Excellent | 250 | Poor |
| Surface roughness (Ra) of external heating belt having been subjected to printing aging test of 120K sheets (At an early stage, Ra = 0.5 μm) | 2 μm | | 1 μm | | 2 μm | | 3 μm | | 12 μm | |
| Slippage of external heating belt | Good (No slippage) | | Good (No slippage) | | Good (No slippage) | | Good (No slippage) | | Bad (Slippage occurred at an early stage) | |

FIXING APPARATUS AND IMAGE FORMING APPARATUS

This Nonprovisional application claims priority under 35 U.S.C. §119(a) on Patent Application No. 2008-228650 filed in Japan on Sep. 5, 2008, the entire contents of which are hereby incorporated by reference.

TECHNICAL FIELD

The present invention relates to a fixing apparatus for use in an electrophotographic image forming apparatus, and also relates to an image forming apparatus including the fixing apparatus.

BACKGROUND ART

As a fixing apparatus for use in an electrophotographic image forming apparatus such as a copying machine or a printer, a heat roller type fixing apparatus is widely used. In general, the heat roller type fixing apparatus includes a pair of rollers (a fixing roller and a pressure roller) which are pressed against each other. This type of fixing apparatus includes heating means (made of a halogen heater, for example) provided inside both or either one of the pair of rollers. This type of fixing apparatus fixes a toner image in the following manner: The heating means heats the pair of rollers to a predetermined temperature (fixing temperature). After that, a recording sheet on which an unfixed toner image is formed is fed to a pressure area (fixing nip area) between the pair of rollers, and then the recording sheet is caused to pass through the pressure area. Thus, the toner image is fixed on the recording sheet due to heat and pressure applied thereto.

Incidentally, a fixing apparatus included in a color image forming apparatus generally uses an elastic roller. The elastic roller is a fixing roller provided with, on its surface, an elastic layer which is made of e.g., silicon rubber. In the case where the elastic roller is used as the fixing roller, a surface of the fixing roller elastically deforms according to an uneven surface of an unfixed toner image, and is in contact with the unfixed toner image so as to cover the unfixed toner image. This allows a color unfixed toner image whose toner amount is larger than that of a monochrome unfixed toner image to be favorably fixed. Further, due to strain release of the elastic layer which occurs in a fixing nip area, it is possible to improve releasability of the fixing roller with respect to color toner, which is more likely to offset than monochrome toner. Furthermore, since the elastic layer of the fixing roller can be depressed, the fixing nip area has a nip shape protruding upward (i.e., toward the fixing roller side), that is, a so-called inverse nip shape. This makes it possible to more favorably separate a sheet from the fixing roller, thereby allowing the sheet to be separated without using any separation means such as a separation claw (self stripping). This eliminates a problem of an image defect which is caused by the separation means.

However, in such a fixing apparatus provided in a color image forming apparatus, increasing a process speed (a traveling speed of a sheet in a fixing nip area; a fixing speed) may cause insufficient heat transfer to an unfixed toner image and thereby lead to improper fixing of the unfixed toner image. In view of this, in order that the process speed is increased while sufficient heat is supplied to the unfixed toner image and the fixing process is carried out properly, it is necessary to increase the nip width of the fixing nip area. As means for increasing the nip width, (1) a method of increasing the thickness of the elastic layer of the fixing roller or (2) a method of increasing the diameter of the fixing roller is considered.

However, since the elastic layer has a very low heat conductivity, the fixing roller which is provided with the elastic layer and internally includes the heating means as in the conventional configuration has such a problem that a surface temperature of the fixing roller cannot respond to a temperature change of the heating means when the process speed is increased. Thus, in the case where the thickness of the elastic layer is increased as in the above-mentioned method (1), the problem with the temperature response of the surface of the fixing roller becomes more serious. In addition, due to the low heat conductivity of the elastic layer, the method (1) also causes problems of: an extended warm-up period for heating; and an increased power consumption.

In the case where the diameter of the fixing roller is increased as in the method (2), the size of the fixing roller is increased and thereby its heat capacity is increased. This causes problems of: an extended warm-up period for heating; and an increased power consumption.

In view of this, as a technique for solving these problems, such a technique (external heat fixing method) is proposed that external heating means is in contact with a surface of a fixing roller so that the fixing roller is heated from the outside.

For example, Patent Literature 1 discloses an external belt heat type fixing apparatus including: a fixing member; an endless belt (external heating belt) suspended by a plurality of suspending rollers; heating means for heating the endless belt, the endless belt being pressed against the fixing member so that the fixing member is heated.

Patent Literature 2 discloses a belt fixing type fixing apparatus including a fixing roller; a heating roller; a fixing belt which is endless and is suspended between an outer peripheral surface of the fixing roller and an outer peripheral surface of the heating roller; and a pressure roller for pressing the fixing roller via the fixing belt, wherein a fixing process is carried out in such a manner that a recording sheet on which an unfixed toner image is formed is fed to a pressure area (fixing nip area) between the fixing belt and the pressure roller and is caused to pass through the pressure area. This belt type fixing method also adopts a configuration in which the fixing belt heated by the heating roller is carried to the surface (outer surface) of the fixing roller so that the fixing roller is heated from the outside. In view of this, this method is also considered to be a kind of the external heat fixing method.

In these fixing apparatuses adopting the external heat fixing method, the belt having a small heat capacity is used to heat the fixing roller from the outside. This makes it possible to heat the fixing roller quickly, thereby leading to a shorter warm-up period. Consequently, it is possible to prevent the problems such as the impaired temperature response of the fixing roller and the extended warm-up period, and also to secure a wide nip width by providing a thick, low-hardness elastic layer to the fixing roller and/or increasing the diameter of the fixing roller, for example.

CITATION LIST

Patent Literature 1

Japanese Patent Application Publication, Tokukai, No. 2007-212896 A (Publication Date: Aug. 23, 2007)

Patent Literature 2

Japanese Patent Application Publication, Tokukai, No. 2007-279344 A (Publication Date: Oct. 25, 2007)

SUMMARY OF INVENTION

Technical Problem

In the technique disclosed in Patent Literature 1, a cleaning web is in contact with the fixing roller on an upstream side (in a rotational direction of the fixing roller) of a contacting section where the fixing roller is in contact with the external heating belt. This enables to remove toner, paper powder, and/or the like adhered to the surface of the fixing roller, thereby preventing the external heating belt from being stained with the toner, the paper powder, and/or the like. This configuration causes the following problem: The fixing belt is scratched due to sliding between the cleaning web and the surface of the fixing roller, and consequently an image defect is caused.

In the technique disclosed in Patent Literature 2, a cleaning roller is pressed against the fixing belt in a region where the fixing belt is suspended by the heating roller, and is caused to be rotated by the fixing belt. Thus, the cleaning roller removes toner, paper powder, and/or the like adhered to the surface of the fixing belt. That is, in the technique of Patent Literature 2, the cleaning roller and the heating roller are pressed against each other via the fixing belt.

This configuration causes such a problem that an image defect easily occurs due to a scratch on the fixing belt which scratch is caused by, for example, a friction resistance between the cleaning roller and the fixing belt, a friction resistance between the fixing belt and the heating roller, and sliding between these members. Further, because the fixing belt is supported by a pressure area between the cleaning roller and the heating roller, a large load occurs on the fixing belt in a direction which hinders the rotation of the fixing belt. This leads to such a problem that slippage easily occurs between the fixing belt and the fixing roller and/or between the fixing belt and the heating roller.

The present invention was made in view of the foregoing problems, and an objective of the present invention is to prevent, in a fixing apparatus utilizing an external heating method, (i) a scratch on a belt member and (ii) slippage of the belt member.

Solution to Problem

In order to solve the foregoing problems, a fixing apparatus according to the present invention includes: a fixing roller; a pressure member for applying pressure against the fixing roller; an endless belt which is rotatably supported and heats the fixing roller by being in contact with a surface of the fixing roller; and heating means for heating the endless belt, by passing a recording material through a nip between the fixing roller and the pressure member, said fixing apparatus fixing an unfixed toner image on the recording material on which the unfixed toner image is transferred, said fixing apparatus further including; a cleaning member for removing dirt adhered to a surface of the endless belt by being in contact with the surface of the endless belt in a region where the endless belt is not supported.

An image forming apparatus of the present invention includes: a fixing apparatus including: a fixing roller; a pressure member for applying pressure against the fixing roller; an endless belt which is rotatably supported and heats the fixing roller by being in contact with a surface of the fixing roller; heating means for heating the endless belt; and a cleaning member, by passing a recording material through a nip between the fixing roller and the pressure member, said fixing apparatus fixing an unfixed toner image on the recording material on which the unfixed toner image is transferred, and the cleaning member removing dirt adhered to a surface of the endless belt by being in contact with the surface of the endless belt in a region where the endless belt is not supported.

According to this configuration, the fixing apparatus includes the cleaning member for removing the dirt adhered to the surface of the endless belt by being in contact with the surface of the endless belt in the region where the endless belt is not supported. This reduces a sliding load generated between the cleaning member and the endless belt, as compared with the conventional configuration in which a cleaning member is in contact with an endless belt in a region where the endless belt is supported by a suspending roller. This prevents the endless belt from being scratched due to sliding (friction) between the cleaning member and the endless belt, and also prevents an increase in a load applied in a direction which hinders the rotation of the endless belt, so that slippage of the endless belt is prevented.

Advantageous Effects of Invention

As described above, the fixing apparatus of the present invention includes the cleaning member for removing the dirt adhered to the surface of the endless belt by being in contact with the surface of the endless belt in the region where the endless belt is not supported.

This prevents the endless belt from being scratched due to sliding between the cleaning member and the endless belt, and also prevents an increase in a load applied in the direction which hinders the rotation of the endless belt, so that slippage of the endless belt is prevented.

BRIEF DESCRIPTION OF DRAWINGS

FIG. 1 is a cross-sectional view of a fixing apparatus according to an embodiment of the present invention.

FIG. 2 is a cross-sectional view of an image forming apparatus according to an embodiment of the present invention.

FIG. 3 shows a front view and a side view of a scraper provided in the fixing apparatus illustrated in FIG. 1.

FIG. 4 is a cross-sectional view of an external heating unit provided in the fixing apparatus illustrated in FIG. 1.

FIG. 5 is an enlarged view of relevant parts of a contacting point at which an external heating belt and the scraper are in contact with each other in the external heating unit provided in the fixing apparatus illustrated in FIG. 1.

FIG. 6 is a side view of an apparatus for evaluating releasability of a surface layer material.

FIG. 7 is a cross-sectional view of an external heating unit of another example provided in the fixing apparatus illustrated in FIG. 1.

FIG. 8 is a cross-sectional view of an external heating unit of further another example provided in the fixing apparatus illustrated in FIG. 1.

FIG. 9 is a cross-sectional view of an external heating unit of still further another example provided in the fixing apparatus illustrated in FIG. 1.

FIG. 10 is a cross-sectional view of an external heating unit of a comparative example.

FIG. 11 is a graph showing the results of measurement of (i) a warp amount of the edge of a scraper included in the external heating unit illustrated in FIG. 4 and (ii) a warp amount of the edge of a scraper included in the external heating unit illustrated in FIG. 9.

FIG. 12 is a cross-sectional view of a fixing apparatus according to another embodiment of the present invention.

FIG. 13

FIG. 13 is a table showing the results of experiments conducted to evaluate cleaning performance.

DESCRIPTION OF EMBODIMENTS

Embodiment 1

One embodiment of the present invention is described below. Described in the present invention is a case where the present invention is applied to a color tandem type image forming apparatus for forming a multi-color image or a monochrome image on a recording material (e.g., a recording sheet or a recording film) in accordance with image data transmitted from the outside. Note that an object to which the present invention is applied is not limited to this, but the present invention may be applied to any image forming apparatus as long as it includes a belt fixing type fixing apparatus or an external belt heat type fixing apparatus.

<Configuration of Image Forming Apparatus>

Figure 2:
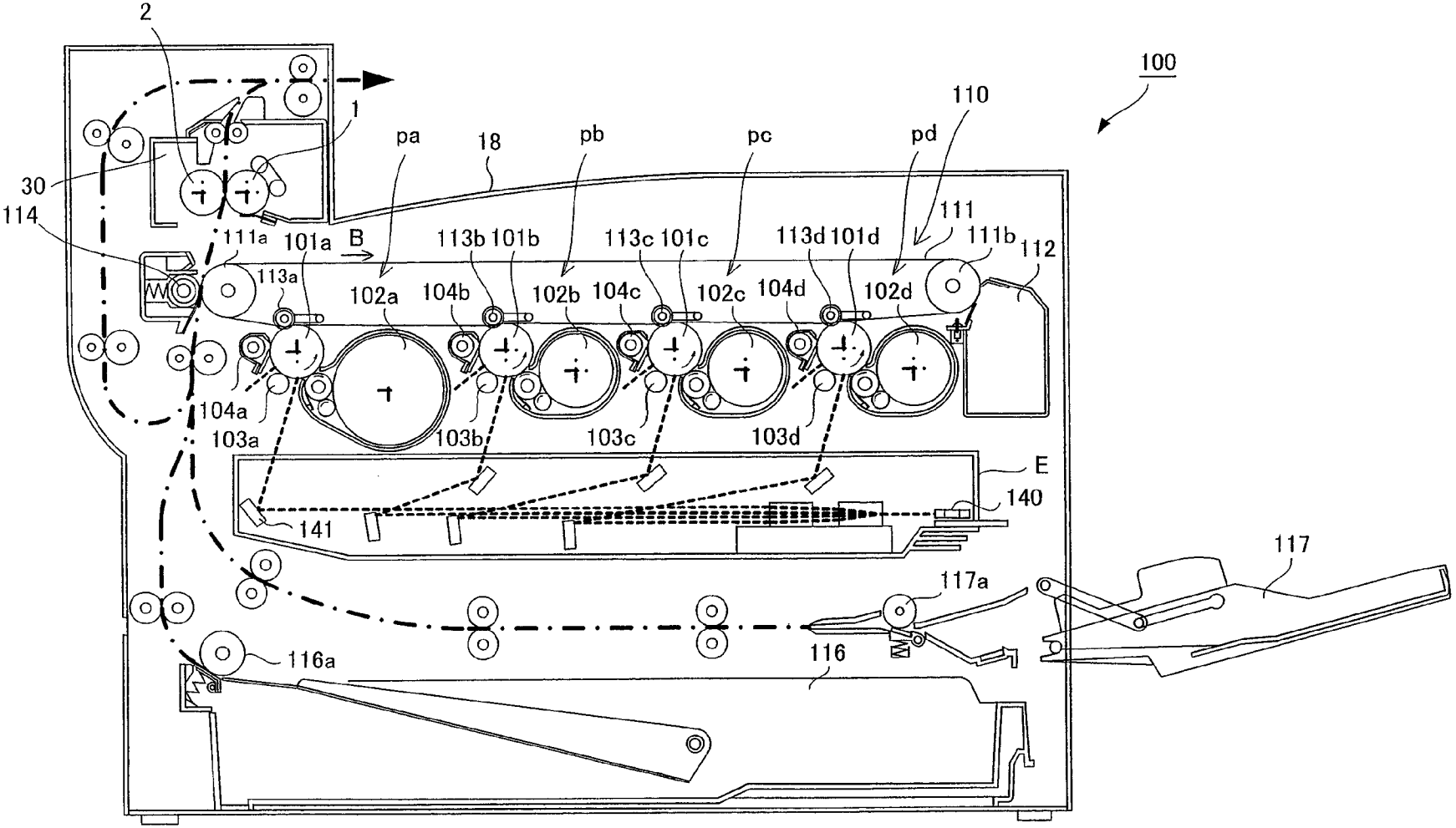
FIG. 2

FIG. 2 is a cross-sectional view schematically illustrating the configuration of an image forming apparatus 100 according to the present embodiment.

As illustrated in FIG. 2, the image forming apparatus 100 includes: an exposure unit (optical system unit) E; four visible image forming units pa to pd; an intermediate transfer belt unit 110; a second transfer unit 114; a fixing apparatus 30; an internal sheet feeding unit 116; and a manual sheet feeding unit 117. Operation of each member included in the image forming apparatus 100 is controlled by a control section (not illustrated) made of e.g., a CPU.

Image data that the image forming apparatus 100 deals with is the one corresponding to a color image expressed by the following colors: black (K), cyan (C), magenta (M), and yellow (Y). Therefore, as illustrated in FIG. 2, the four visible image forming units pa to pd, which correspond to the above-mentioned colors, respectively, are provided. These four visible image forming units pa to pd form toner images of the four colors, respectively, and the toner images formed are caused to overlap each other on the intermediate transfer belt 111.

The visible image forming unit pa is configured such that a charging unit 103*a*, a developing unit 102*a*, and a cleaning unit 104*a* are provided around a photoreceptor 101*a* in this order along a rotational direction of the photoreceptor 101*a*. The photoreceptor 101*a* is a toner image bearing member, and is rotatably mounted.

The charging unit 103*a* uniformly charges a surface of the photoreceptor 101*a* at a predetermined potential. In the present embodiment, the charging unit 103*a* adopts a charging roller method (contact charging method), for the purpose of uniformly charging the surface of the photoreceptor 101*a* while preventing the generation of ozone as much as possible. Note that the configuration of the charging unit 103*a* is not limited to this. Instead of this, for example, a non-contact type charger (e.g., a corona charging type charger) or a contact-type charger (e.g., a brush charging type charger) may be used.

The developing unit 102*a* carries out a developing process in which an electrostatic latent image formed on the photoreceptor 101*a* is made visible with use of toner. The toner may be, for example, nonmagnetic single-component developer (nonmagnetic toner), nonmagnetic two-component developer (nonmagnetic toner and carrier), or magnetic developer (magnetic toner).

The cleaning unit 104*a* removes and collects toner remaining on the surface of the photoreceptor 101*a* after a toner image has been transferred onto the intermediate transfer belt 111.

Note that the visible image forming units pb to pd have substantially the same configuration as that of the visible image forming unit pa, except that the visible image forming units pa to pd deal with different colors of toner in the developing process. That is, the developing unit of the visible image forming unit pa contains black (K) toner; the developing unit of the visible image forming unit pb contains yellow (Y) toner; the developing unit of the visible image forming unit pc contains magenta (M) toner; and the developing unit of the visible image forming unit pd contains cyan (C) toner.

The exposure unit E exposes, in accordance with image data, the photoreceptors 101*a* to 101*d* respectively charged by the charging units 103*a* to 103*d*. Consequently, electrostatic latent images are formed on the respective surfaces of the photoreceptors 101*a* to 101*d* in accordance with the image data. The exposure unit E uses a laser scanning unit (LSU) including e.g., a laser irradiation section 140 and a reflection mirror 141. Note that the exposure unit E may be realized by, for example, an EL or LED writing head in which light-emitting elements are arranged in an array-shape.

The intermediate transfer belt unit 110 includes the intermediate transfer belt 111, an intermediate transfer belt driving roller (tension roller) 111*a*, an intermediate transfer belt driven roller (tension roller) 111*b*, an intermediate transfer belt cleaning unit 112, and intermediate transfer rollers 113*a* to 113*d*.

The intermediate transfer belt 111 is an endless belt made of a film having a thickness of approximately 100 μm to approximately 150 μm. The intermediate transfer belt 111 is suspended by the intermediate transfer rollers 113*a* to 113*d*, the intermediate transfer belt driving roller 111*a*, and the intermediate transfer belt driven roller 111*b*, and is rotated in a direction indicated by the arrow B in FIG. 2. Further, the toner images of the respective colors formed on the photoreceptors 101*a* to 101*d* are transferred onto the intermediate transfer belt 111 in order so that the toner images overlap each other. Thus, a color toner image (multi-color toner image) is formed on the intermediate transfer belt 111. The intermediate transfer roller 113*a* faces the photoreceptor 101*a* via the intermediate transfer belt 111 in a position between (i) a part where the photoreceptor 101*a* faces the unit 102*a* and (ii) a part where the photoreceptor 101*a* faces the cleaning unit 104*a*. The same applies to the intermediate transfer rollers 113*b* to 113*d*. Applying to the intermediate transfer rollers 113*a* to 113*d* a high voltage having a polarity (+) reverse to a charging polarity (−) of the toner allows the respective toner images on the photoreceptors 101*a* to 101*d* to be transferred onto the intermediate transfer belt 111. The toner image formed on the intermediate transfer belt 111 is carried to a region where the intermediate transfer belt driving roller 111*a* faces the second transfer unit 114, and is transferred onto a recording sheet carried to the region. The intermediate transfer belt cleaning unit 112 is in contact with the intermediate transfer belt 111 for removing and collecting the toner remaining on the intermediate transfer belt 111 after the toner image has been transferred onto the recording sheet.

The fixing apparatus 30 includes: a fixing roller 1; and a pressure roller (pressure member) 2 which is pressed against the fixing roller 1 at a predetermined load by means of pressure means (not illustrated). The recording sheet on which the toner image is transferred by means of the second transfer unit 114 is fed to a pressure area (fixing nip area) between the fixing roller 1 and the pressure roller 2, and is caused to pass through the pressure area. Thus, in the fixing apparatus 30, the toner image is fixed by heat and pressure. A surface of the recording sheet on which surface the unfixed toner image is formed comes in contact with the fixing roller 1, and the other surface of the recording sheet which surface is opposite to the surface on which the unfixed toner image is formed comes in contact with the pressure roller 2. The details of the fixing apparatus 30 will be described later.

The internal sheet feeding unit 116 stores recording sheets (recording materials) used in image formation. The manual sheet feeding unit 117 is provided on a lateral side of the image forming apparatus 100 in a freely foldable manner. The manual sheet feeding unit 117 allows a user to manually feed a recording sheet. On a sheet output tray 18, a recording sheet on which an image is formed is placed.

Further, the image forming apparatus 100 includes a sheet carrying path through which (i) a recording sheet fed from the internal sheet feeding unit 116 by means of a pickup roller 116*a* or (ii) a recording sheet fed from the manual sheet feeding unit 117 by means of a pickup roller 117*a* is conveyed to the sheet output tray 18 via the second transfer unit 114 and the fixing apparatus 30. In the sheet carrying path, a number of roller members for carrying a recording sheet are provided.

<Fixing Apparatus>

Figure 1:
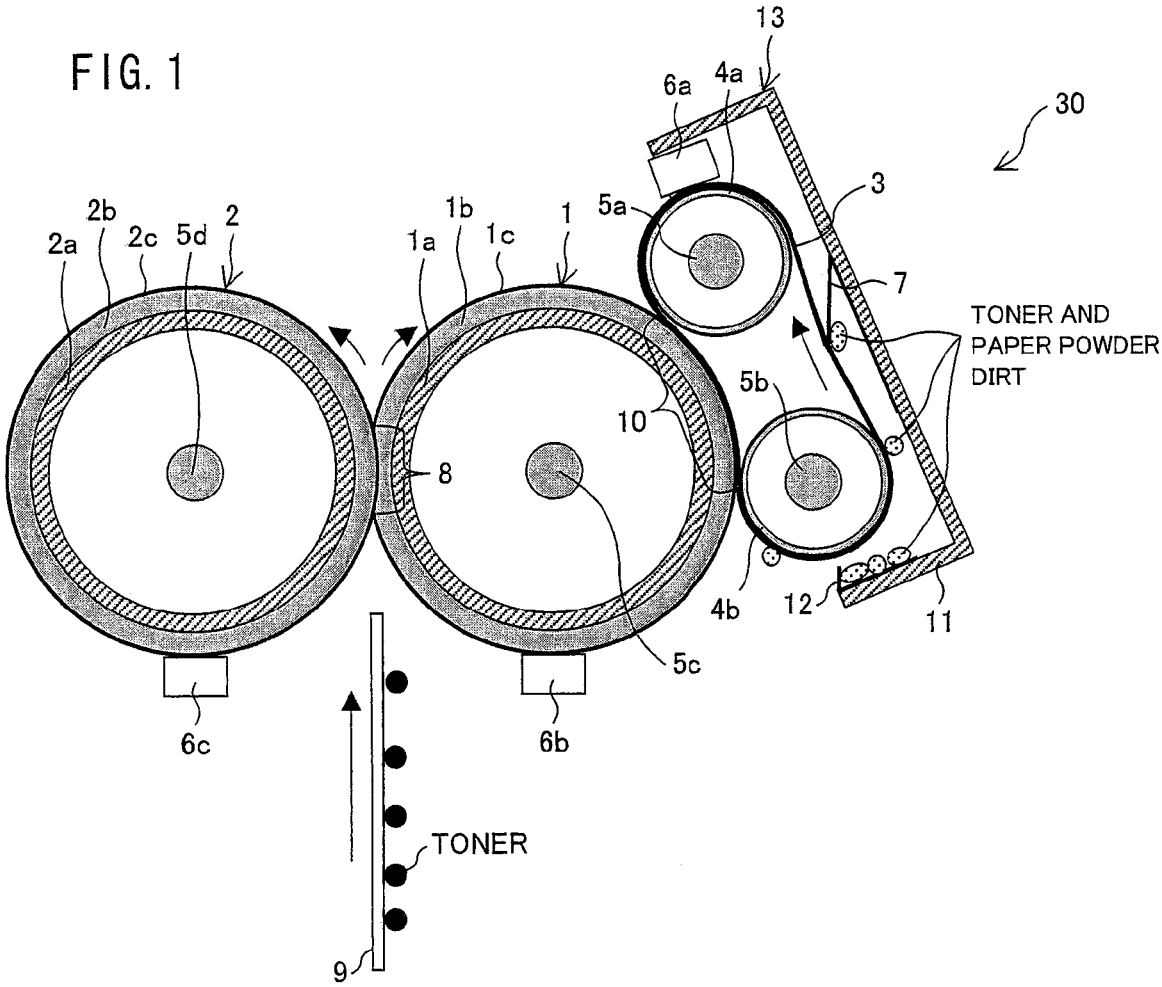
FIG. 1

FIG. 1 is a cross-sectional view illustrating the configuration of the fixing apparatus 30. As illustrated in FIG. 1, the fixing apparatus 30 includes the fixing roller (fixing member) 1, the pressure roller (pressure member) 2, and an external heating unit (external heating device) 13.

The fixing roller 1 is heated to a predetermined fixing temperature (in the present embodiment, 180° C.), and is rotated by means of rotating means (not illustrated) in a direction indicated by the arrow in FIG. 1. The fixing roller 1 has a three-layer configuration including: a core 1*a* which is made of metal and shaped in a hollow cylinder; an elastic layer 1*b* covering an outer peripheral surface of the core 1*a*; and a releasing layer 1*c* covering the elastic layer 1*b*. In the present embodiment, a traveling speed of a surface of the fixing roller 1 i.e., a fixing speed (process speed) is set to 225 mm/sec. This allows for image formation at a copying speed (printing speed) of 40 sheets/min.

The core 1*a* is made of aluminum having a thickness of 2 mm and is shaped in a hollow cylinder. Note that the material of the core 1*a* is not limited to aluminum, but may be, for example, iron or stainless steel. The elastic layer 1*b* is made of silicon rubber which has a thickness of 2.5 mm and a heat-resisting property. Note that the material of the elastic layer 1*b* is not limited to silicon rubber, but may be, for example, fluorine-containing rubber. The releasing layer 1*c* is made of a PFA (a copolymer of tetrafluoroethylene and perfluoroalkylvinylether) tube having a thickness of 40 μm. Note that the material of the releasing layer 1*c* only needs to be excellent in heat resistance, durability, and releasability with respect to toner, and may be a fluorinated material such as PTFE (polytetrafluoroethylene) instead of PFA. The fixing roller 1 configured in this manner has an outer diameter of 40 mm.

For an outer peripheral surface of the fixing roller 1, a thermistor 6*b* is provided which detects the temperature of the outer peripheral surface. The fixing roller 1 internally includes a heater lamp 5*c* which radiates heat in response to electric power supplied thereto. The heater lamp 5*c* is a heat source for the fixing roller 1. The control section (not illustrated) controls electric power supplied from a power source circuit (not illustrated) to the heater lamp 5*c* so as to cause the heater lamp 5*c* to emit light and thereby to radiate an infrared ray. An inner peripheral surface of the fixing roller 1 absorbs the infrared ray radiated from the heater lamp 5 and then is heated, so that the whole of the fixing roller 1 is heated.

The pressure roller 2 is pressed against the fixing roller 1 at a predetermined load (in the present embodiment, 360 N) by means of pressure member (not illustrated) such as a spring, so that a fixing nip area 8 (in the present embodiment, a fixing nip width (the width of the fixing nip area 8 in a direction in which a recording sheet 9 is carried): 8 mm) is formed. The pressure roller 2 is rotated by the fixing roller 1. As well as the fixing roller 1, the pressure roller 2 has a three-layer configuration including: a core 2*a* which is made of metal and shaped in a hollow cylinder; an elastic layer 2*b* covering an outer peripheral surface of the core 2*a*; and a releasing layer 2*c* covering the elastic layer 2*b*.

In the present embodiment, as well as the fixing roller 1, the pressure roller 2 is configured so as to include the core 2*a* made of aluminum having a thickness of 2 mm; the elastic layer 2*b* which is provided on the core 2*a* and is made of silicon rubber having a thickness of 2.5 mm; and the releasing layer 2*c* which is provided on the elastic layer 2*b* and is made of a PFA tube having a thickness of 40 μm. Note that the configuration of the pressure roller 2 is not limited to this. Instead of this, for example, the pressure roller 2 may include: a core 2*a* made of e.g., iron, or stainless steel; an elastic layer 2*b* made of e.g., fluorine-containing rubber; and a releasing layer 2*c* made of a fluorinated material such as PTFE. The present embodiment uses the pressure roller 2 whose shape and material are the same as those of the fixing roller 1. However, the present invention is not limited to this. Instead, for example, the hardness of the pressure roller 2 may be set to be higher than that of the fixing roller 1. In this case, it is possible to form a fixing nip area between the pressure roller 2 and the fixing roller 1 in an inverse nip shape (i.e., a shape made by the pressure roller 2 whose shape is hardly changed and the fixing roller 1 which is depressed slightly). This improves a self-stripping property of a recording sheet with respect to the fixing roller 1 observed when the recording sheet is discharged from the fixing nip area.

Further, for an outer peripheral surface of the pressure roller 2, a thermistor 6*c* is provided which detects the temperature of the outer peripheral surface. The pressure roller 2 internally includes a heater lamp 5*d*. The heater lamp 5*d* is a heat source for the pressure roller 2. The control section (not illustrated) controls electric power supplied from the power source circuit (not illustrated) to the heater lamp 5*d* so as to cause the heater lamp 5*d* to radiate an infrared ray. Thus, an inner peripheral surface of the pressure roller 2 is heated.

The external heating unit 13 heats an outer peripheral surface of the fixing roller 1. The external heating unit 13 includes heating rollers 4*a* and 4*b*, an external heating belt (endless belt) 3, heater lamps (heating means) 5*a* and 5*b*, a thermistor 6*a*, a scraper (cleaning member) 7, a toner receiver (containing member) 12, and an external heating unit holder (housing) 11 for accommodating these members.

Each of the heating rollers 4*a* and 4*b* is a hollow, cylindrical core material which is made of aluminum and has a thickness of 0.75 mm and a diameter of 16 mm. Note that the material of each of the heating rollers 4*a* and 4*b* is not limited to aluminum, but may be, for example, a core material made of metal such as iron or stainless steel. Further, the size of each of the heating roller 4*a* and 4*b* is not limited to the foregoing one, but may be changed as needed.

The external heating belt 3 is an endless belt member which is suspended by the heating rollers 4*a* and 4*b*. In the present embodiment, the external heating belt 3 includes: a belt substrate which is made of polyimide and has a diameter of 31.5 mm and a thickness of 90 μm; and a PTFE coating which is provided on the belt substrate and has a thickness of 20 μm. Note that the configuration of the external heating belt 3 is not limited to this. For example, instead of the belt substrate made of polyimide, a hollow, cylindrical (endless) belt substrate made of other heat-resistive resin or a metal material such as stainless steel or nickel may be used. Further, the external heating belt 3 may have a two-layer configuration in which a synthetic resin material (e.g., fluororesin such as PFA or PTFE), excellent in heat resistance and releasability, is provided on an outer surface of the belt substrate as the releasing layer. In the present embodiment, a PTFE coating is applied to an inner surface of the belt substrate so that a deviation force (a force which causes the external heating belt 3 to move in a rotational axis direction (a direction of the width of the external heating belt 3) while the external heating belt 3 is rotating) of the external heating belt 3 is reduced. However, the present invention is not limited to this. Instead of this, for example, the coating may be made of other fluororesin such as PFA, or the coating may be omitted.

The external heating belt 3 is pressed against the fixing roller 1 at a predetermined load (in the present embodiment, 40 N) by means of pressure means (not illustrated) such as a spring. The region where the external heating belt 3 is pressed against the fixing roller 1 is on a downstream side (in a rotational direction of the fixing roller 1) of the fixing nip area 8 on the surface of the fixing roller 1 and on an upstream side (in the rotational direction of the fixing roller 1) of the thermistor 6*b*. Thus, a heating nip area (an area where the fixing roller 1 and the external heating belt 3 are in contact with each other) 10 is formed between the fixing roller 1 and the external heating belt 3. The external heating belt 3 is rotated by the fixing roller 1 while the fixing roller 1 is rotating. The heating rollers 4*a* and 4*b* are rotated by the external heating belt 3. Note that a heating nip width (the width of the heating nip area 10 in the rotational direction of the fixing roller 1) of the heating nip area 10 may be set as needed so that the external heating belt 3 suitably heats the fixing roller 1 and the external heating belt 3 is suitably rotated by the fixing roller 1. In the present embodiment, the heating nip width is set to 20 mm.

The heater lamp 5*a* is a heat source which is included in the inside of the heating roller 4*a* and which heats the heating roller 4*a* from the inside. The heater lamp 5*b* is a heat source which is included in the inside of the heating roller 4*b* and which heats the heating roller 4*b* from the inside. The control section (not illustrated) controls electric power supplied from the power source circuit (not illustrated) to the heater lamps 5*a* and 5*b* so that the heater lamps 5*a* and 5*b* radiate an infrared ray. Thus, respective inner peripheral surfaces of the heating rollers 4*a* and 4*b* are heated. Then, the external heating belt 3 is heated to a predetermined temperature (in the present embodiment, 220° C.) via the heating rollers 4*a* and 4*b*. The external heating belt 3 heated to the predetermined temperature is in contact with the surface of the fixing roller 1, so that the surface of the fixing roller 1 is heated from the outside.

The thermistor 6*a* detects a surface temperature of the external heating belt 3.

The scraper (cleaning member) 7 cleans up the surface of the fixing roller 1 by removing dirt such as toner and/or paper powder transferred from the fixing roller 1 onto the external heating belt 3.

That is, as illustrated in FIG. 1, in order to fix toner which is not fixed yet, the fixing roller 1 comes in contact with a surface of the recording sheet 9 on which surface an unfixed toner image is formed. Due to this, dirt such as toner and/or paper powder on the recording sheet 9 is adhered to the fixing roller 1. The dirt such as toner and/or paper powder adhered on the fixing roller 1 then adheres to the external heating belt 3 in a contacting section where the fixing roller 1 is in contact with the external heating belt 3. The scraper 7 scrapes off and removes the dirt such as toner and/or paper powder adhered to the external heating belt 3 in this manner.

The toner receiver 12 stores toner, paper powder, and/or the like that the scraper 7 has removed from the external heating belt 3. The toner receiver 12 is provided in a space below the scraper 7 and between the external heating unit holder 11 and the external heating belt 3. The material of the toner receiver 12 is not particularly limited. For example, the toner receiver 12 may be formed by bending a metal plate made of e.g., phosphor bronze or stainless steel. Without the toner receiver 12, there may be a case where toner dirt scooped up by the scraper 7 drops from the scraper 7, is discharged from the external heating unit 13, and adheres to the fixing roller 1, so that the recording sheet 9 is stained with the toner. On the other hand, with the toner receiver 12, even in a case where dirt such as toner scraped off by the scraper 7 drops from the tip of the scraper 7, the toner receiver 12 collects the dropped toner. Therefore, it is possible to prevent the dropped toner from adhering to the fixing roller 1 again and staining the recording sheet 9.

In accordance with the temperature detection results obtained by the thermistors 6*a*, 6*b*, and 6*c*, the control section controls electric power supplied to the heater lamps 5*a* to 5*d* so that the temperatures of the external heating belt 3, the fixing roller 1, and the pressure roller 2 become close to or maintain the predetermined temperatures, respectively.

As described above, the fixing apparatus 30 fixes an unfixed toner image on a recording sheet 9 in the following manner: In the state where the fixing roller 1 and the pressure roller 3 have been heated to the respective predetermined temperatures and are pressed against each other at the predetermined load, the recording sheet 9 on which the unfixed toner image is passed through a nip between the fixing roller 1 and the pressure roller 2.

In the present embodiment, each of the fixing roller 1 and the pressure roller 2 internally includes the heater lamp as the heating means. However, the present invention is not limited to this. For example, only either of the fixing roller 1 or the pressure roller 2 may include the heater lamp, or neither of the fixing roller 1 nor the pressure roller 2 may include the heater lamp.

In the present embodiment, the external heating belt 3 is suspended by the two heating rollers 4*a* and 4*b*. However, the present invention is not limited to this. Instead of this, the external heating belt 3 may be suspended by three or more rollers.

In the present invention, the pressure roller 2 is used as the pressure member for pressing the fixing roller 1. However, the configuration of the pressure member is not limited to this. Instead of this, for example, a belt-shaped pressure member may be used.

<Detailed Description of Scraper>

Figure 3:
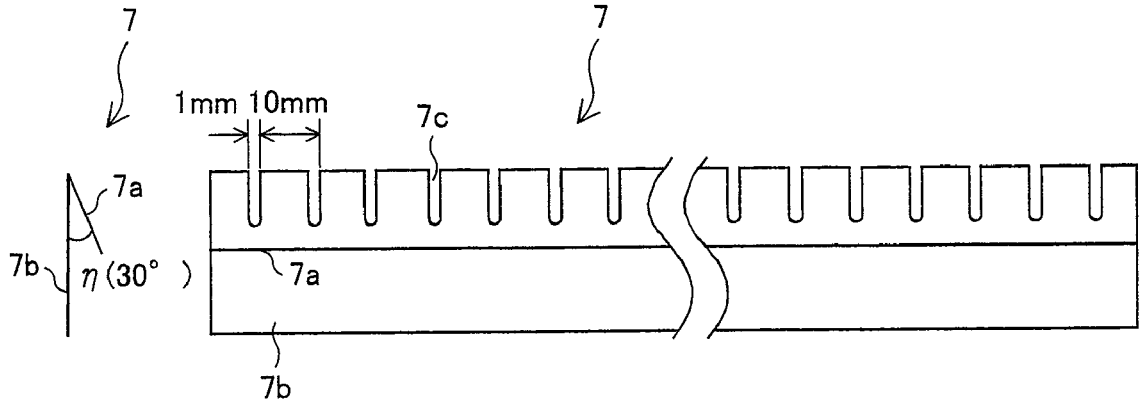
FIG. 3

FIG. 3 shows a front view and a side view of the scraper 7. The scraper 7 has a V-shape made by: a supporting section 7*b* made of stainless steel having a thickness of 0.3 mm; and a cleaning section (scraper section) 7*a* which is formed by bending of the top end region of the supporting section 7*b* at a sharp angle (an angle η; in the present embodiment, η=30°). As illustrated in FIG. 3, slits (openings) 7*c* (e.g., cuttings each of which is formed along a direction perpendicular to a straight line made by the bending portion) are formed in (i) a part of the supporting section 7*b* which part includes the bending portion and (ii) a part of the cleaning section 7*a* which part includes the bending portion. The slits 7*c* are arranged along a direction of the width of the external heating belt 3 while maintaining a predetermined interval between the slits 7*c*. In the present embodiment, the slits 7*c* each of which is formed along the direction substantially perpendicular to the straight line made by the bending portion and has a width of 1 mm are arranged at 10-mm intervals. In the present embodiment, the surface of the scraper 7 is coated with PFA.

Figure 4:
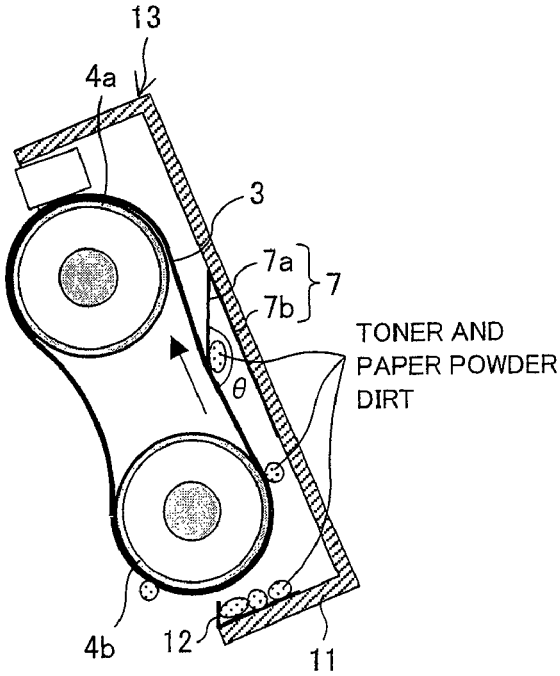
FIG. 4

FIG. 4 is a cross-sectional view of the external heating unit 13. As illustrated in FIG. 4, the supporting section 7*b* of the scraper 7 is fixed to an inner surface side of the external heating unit holder 11 so that the tip of the cleaning section 7*a* of the scraper 7 comes in contact with the external heating belt 3. In a region where the external heating belt 3, suspended between the heating rollers 4*a* and 4*b* under tension, is free (i.e., a region where an inner surface of the external heating belt 3 is not in contact with the heating roller 4*a* and 4*b*), the tip of the cleaning section 7*a* is in contact with an outer surface of the external heating belt 3. The tip (edge) of the cleaning section 7*a* is in contact with the external heating belt 3 in a counter direction with respect to a rotational direction of the external heating belt 3. That is, the tip of the cleaning section 7*a* is in contact with the external heating belt 3 so that a contacting angle θ (in the present embodiment, θ=150°) becomes greater than 90°. Here, the contacting angle θ refers to an angle made by (i) a part of the outer surface of the external heating belt 3 which part extends, toward an upstream of the rotational direction of the external heating belt 3, from a contacting point at which the external heating belt 3 and the scraper 7 are in contact with each other and (ii) a surface of the scraper 7 which surface faces the upstream of the rotational direction of the external heating belt 3 and includes said contacting point.

Figure 5:
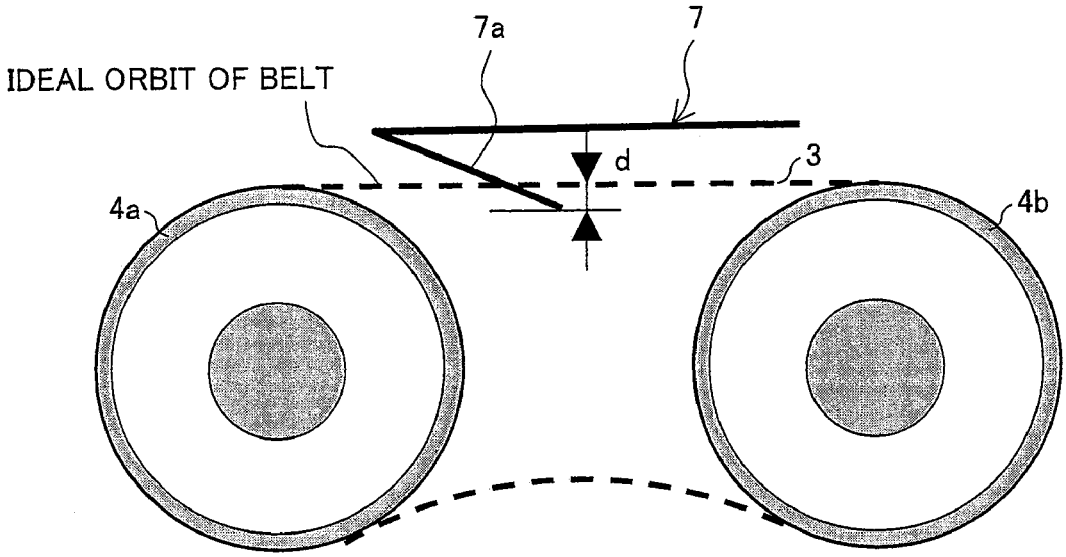
FIG. 5

FIG. 5 is an enlarged view illustrating relevant parts of the contacting point at which the external heating belt 3 and the scraper 7 are in contact with each other in the external heating unit 13. As illustrated in FIG. 5, the shape and the installation position of the scraper 7 are set so that the tip of the cleaning section 7*a* of the scraper 7 pushes down the external heating belt 3 and causes the external heating belt 3 to deviate from an ideal orbit of the external heating belt 3 by a predetermined pushed amount d (in the present embodiment, d=0.6 mm). The "ideal orbit" is, in other words, a common tangent line extending between the external heating rollers 4*a* and 4*b*. Here, the external heating roller 4*a* is provided on a downstream side (in the rotational direction of the external heating belt 3) of the contacting point at which the scraper 7 and the external heating belt 3 are in contact with each other, and the external heating roller 4*b* is provided on an upstream side (in the rotational direction of the external heating belt 3) of the contacting point.

As described above, in the fixing apparatus 30 according to the present invention, the scraper 7 for cleaning up the surface of the external heating belt 3 is in contact with the outer surface of the external heating belt 3 in the region where the inner surface of the external heating belt 3 is not in contact with the heating rollers 4*a* and 4*b*.

With this, it is possible to reduce a sliding load generated between the cleaning member and the external heating belt, as compared with the conventional configuration in which a cleaning member is in contact with an external heating belt in a region where the external heating belt is suspended by a suspending roller. This prevents the external heating belt from being scratched due to sliding between the cleaning member and the external heating belt, and also prevents an increase in a load applied in a direction which hinders the rotation of the endless belt, so that slippage of the endless belt is prevented.

In the present embodiment, the scraper 7 scrapes off and removes toner and/or the like adhered to the surface (outer surface) of the external heating belt 3 by causing the edge of a plate member, used as the cleaning member, to be in contact (line contact) with the external heating belt 3. However, the present invention is not limited to this. The cleaning member only needs to be in contact with the external heating belt 3 and clean up the surface of the external heating belt 3. Instead of the scraper 7, for example, a member made of a sponge or a roller-shaped member may be used, or a cleaning web may also be used.

However, the use of the scraper 7 as in the present embodiment brings an advantage of solving a problem occurred in a case where the cleaning web is used as the cleaning member i.e., a problem that silicon oil contained in the cleaning web impairs the releasability of a sheet with respect to the fixing roller. Further, the use of the scraper as the cleaning member simplifies the configuration of the cleaning member and reduces the size of the cleaning member, as compared with the configuration adopting the cleaning web. This brings an advantage of reducing the size of the fixing apparatus 30.

In the present embodiment, the scraper 7 made of stainless steel is used. However, the material of the scraper 7 is not limited to this. Instead of this, for example, a metal plate made of other metal such as phosphor bronze may be used. Further, the material of the scraper may be a non-metal material such as heat-resistive resin or heat-resistive, high-hardness rubber. Note that, the scraper 7 made of metal is preferable. The reason for this is as follows: Since metal provides a higher processing accuracy than other materials such as rubber and resin, making the scraper 7 of metal allows the tip of the scraper 7 easily to be in contact with the external heating belt 3 uniformly. This reduces the sliding load between the external heating belt 3 and the scraper 7, thereby preventing slippage of the external heating belt 3.

Further, the thickness of the scraper 7 is not limited to the above-described thickness, and may be changed as needed. Furthermore, the shape of the scraper 7 is not limited to the V-shape, but only needs to allow the scraper 7 to be in contact with the external heating belt 3 so that the scraper 7 cleans up the surface of the external heating belt 3.

In a case where the scraper 7 made of a material (e.g., metal) causing thermal expansion is used, it is preferable that the slit 7*c* is provided in the bending portion between the cleaning section 7*a* and the supporting section 7*b* as described above. This configuration prevents such a case that, due to the thermal expansion of the scraper 7, the tip of the cleaning section 7*a* is deformed to have a wavy shape which partially creates gaps between the external heating belt 3 and the scraper 7. That is, this configuration allows the tip of the cleaning section 7*a* to be in contact with the external heating belt 3 uniformly. Note that the shape of the slit 7*c*, the number of the slits 7*c*, and the interval between the slits 7*c* are not limited to those indicated in FIG. 3, but may be changed as needed as long as they allow the edge of the cleaning section 7*a* to be in contact with the external heating belt 3 uniformly even in a case where the thermal expansion of the scraper 7 occurs.

In the present embodiment, the contacting angle θ of the tip of the scraper 7 with respect to the external heating belt 3 is set to 150°. The present invention is not limited to this. However, it is preferable that (i) the contacting angle θ of the tip of the scraper 7 with respect to the external heating belt 3 is made in the counter direction with respect to the rotational direction of the external heating belt 3 and (ii) the counter angle θ is 135° or greater but not greater than 165°. In a case where the contacting angle θ of the scraper 7 is smaller than 135°, the tip of the scraper 7 may be dragged by the external heating belt 3 and inverted (i.e., the tip of the scraper 7 may be caused to be in contact with the external heating belt 3 in a "with direction" (a direction corresponding to the rotational direction of the external heating belt 3; a direction causing the contacting angle θ to be smaller than 90°) with respect to the rotational direction of the external heating belt 3). In a case where the contacting angle θ is greater than 165°, the tip of the scraper 7 tilts too much toward the external heating belt 3. This causes the scraper 7 to be in contact with the external heating belt 3 almost in a surface contact manner (a state where the plate-shaped portion of the scraper section 7*a* is in contact with the external heating belt 3 in a surface contact manner, rather than a state where the tip of the scraper section 7*a* is in contact with the external heating belt 3 in a line contact manner). This may lead to insufficient cleaning performance.

In the present embodiment, the pushed amount d for which the tip of the scraper 7 pushes down the external heating belt 3 is set to 0.6 mm. However, the present invention is not limited to this, but it is preferable that the pushed amount d for which the tip of the scraper 7 pushes down the external heating belt 3 is 0.3 mm or more but not more than 1.0 mm. In a case where the pushed amount d of the scraper 7 is less than 0.3 mm, the following case may occur: When the external heating belt 3 rotates while being corrugated, a gap is created between the scraper 7 and the external heating belt 3, and dirt scraped off from the external heating belt 3 passes through the gap between the scraper 7 and the external heating belt 3. In a case where the pushed amount d is more than 1 mm, the following case may occur: A load that the scraper 7 applies to the external heating belt 3 increases, and accordingly the tip of the scraper 7 damages (scratches) the external heating belt 3. Further, the increased load applied to the external heating belt 3 increases the load applied in the direction which hinders the rotation of the external heating belt 3, and this leads to slippage of the external heating belt 3 with respect to the heating rollers 4*a* and 4*b*.

In the present embodiment, the surface of the scraper 7 is coated with PFA. This prevents the toner scraped off by the tip of the scraper 7 from being adhered to and accumulated on the tip of the scraper 7. Consequently, it is possible to prevent the scraper 7 from being subjected to a local load due to dirt such as accumulated toner, and accordingly to elongate the life of the scraper 7. Note that, the material of the coating of the scraper 7 is not limited to PFA. Examples of the material of the coating of the scraper 7 encompass other fluororesin materials such as PTFE and a blend of fluororesin of a plurality of different kinds.

Note that, it is preferable that the material of the coating of the scraper 7 is different from the fluororesin material used for the releasing layer of the external heating belt 3. In a case where the coating of the scraper 7 and the releasing layer of the external heating belt 3 are made of a fluororesin material of the same kind, an affinity between the materials is increased, and a friction coefficient between the scraper 7 and the external heating belt 3 becomes higher. This may cause the following problems: slippage occurs between the external heating belt 3 and the fixing roller 1; and the scraper 7 is dragged by the external heating belt 3 due to a friction force and then is inverted.

In the present embodiment, the PFA tube is used for a surface layer (releasing layer) of the fixing roller 1, and PTFE, whose toner releasability is lower than that of the PFA tube, is used for a surface layer (releasing layer) of the external heating belt 3. By setting the toner releasability of the surface of the external heating belt 3 to be lower than that of the surface of the fixing roller 1 as described above, toner dirt adhered to the fixing roller 1 easily transfers to the external heating belt 3. Therefore, it is possible to improve the cleaning effect of the external heating belt 3 with respect to the surface of the fixing roller 1, and accordingly to prevent the surface of the fixing roller 1 from being stained with toner. Examples of a combination of materials allowing the toner releasability of the surface of the external heating belt 3 to be lower than that of the surface of the fixing roller 1 encompass: (1) a configuration (the configuration of the present embodiment) in which a PFA tube is used for the releasing layer of the fixing roller 1 and a PTFE coating is used for the releasing layer of the external heating belt 3; (2) a configuration in which a PFA tube is used for the releasing layer of the fixing roller 1 and a PFA coating is used for the releasing layer of the external heating belt 3; and (3) a configuration in which a PFA coating is used for the releasing layer of the fixing roller 1 and a PTFE coating is used for the releasing layer of the external heating belt 3.

However, in a case where the amount of toner that can be scraped off by the scraper 7 is limited because a space and/or the like is limited, transferring too much toner from the fixing roller 1 to the external heating belt 3 may lead to a situation in which dirt such as toner and/or paper powder overflows from the scraper 7 i.e., a situation in which the toner receiver 12 cannot accommodate all of the toner and/or paper powder scraped off by the scraper 7. In such a case, the surface layer material of the outer surface of the external heating belt 3 may be the same as the surface layer material of the fixing roller 1. In this case, although the toner releasability of the surface of the external heating belt 3 is the same as that of the surface of the fixing roller 1, the temperature of the external heating belt 3 is generally higher than that of the fixing roller 1. Therefore, toner does not easily transfer to the external heating belt 3. Thus, even in a case where a space for accommodating the toner receiver 12 is limited, it is possible to prevent the transfer of a too much amount of toner from the fixing roller 1 to the external heating belt 3, and accordingly to prevent an overflow of toner dirt from the scraper 7 and/or the toner receiver 12.

Figure 6:
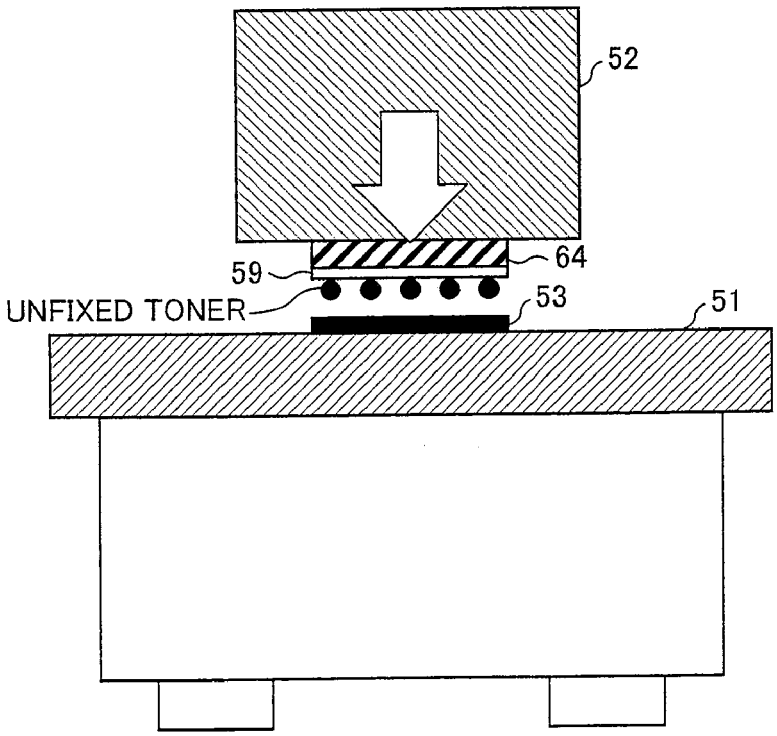
FIG. 6

The method of evaluating toner releasability may be, for example, a method indicated below. FIG. 6 is a side view illustrating the configuration of a device for evaluating the releasability of the surface layer material.

Firstly, an external heating belt 53 is cut into a predetermined size (here, 30 mm×30 mm), and the external heating belt 53 is placed on a hot plate 51 so that a surface layer material of the external heating belt 53 is on the upper side. Then, the external heating belt 53 is heated to a predetermined temperature (here, 100° C. to 150° C.). Subsequently, a sheet 59 on which a predetermined unfixed toner image is formed is pressed against the surface layer material of the external heating belt 53 at a predetermined load (here, 10 N) with use of a counter weight 52. Note that a silicon rubber layer 64 is provided between the counter weight 52 and the sheet 59 so that the load is applied to the sheet 59 uniformly. After a predetermined period of time (here, 1 minute) has passed, the sheet 59 is stripped from the external heating belt 53. Then, it is checked how much molten toner remains on the surface layer material of the external heating belt 53.

Generally, it gets difficult for toner dirt to adhere, as the releasability of the material becomes higher (more excellent) and as the temperature becomes higher. In view of this, in a case where the heating temperatures for surface layer materials of external heating belts 53 are the same, it is possible to determine that a surface layer material of an external heating belt 53 on which surface layer material a smaller amount of toner remains has a higher (better) releasability. Also, in a case where the amounts of toner remaining on surface layer materials of external heating belts 53 are the same, it is possible to determine that a surface layer material subjected to a higher heating temperature has a lower (poorer) releasability.

<Results of Experiments>

The following describes the results of the experiments conducted to examine the relationship between the cleaning performance and the followings: a contacting point at which the scraper 7 is in contact with the external heating belt 3; a contacting angle of the scraper 7 with respect to the external heating belt 3; and the shape of the scraper 7.

Figure 7:
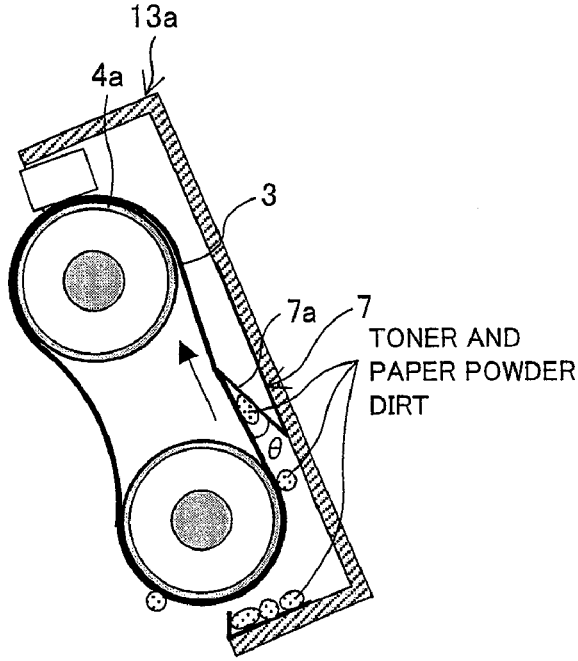
FIG. 7
Figure 8:
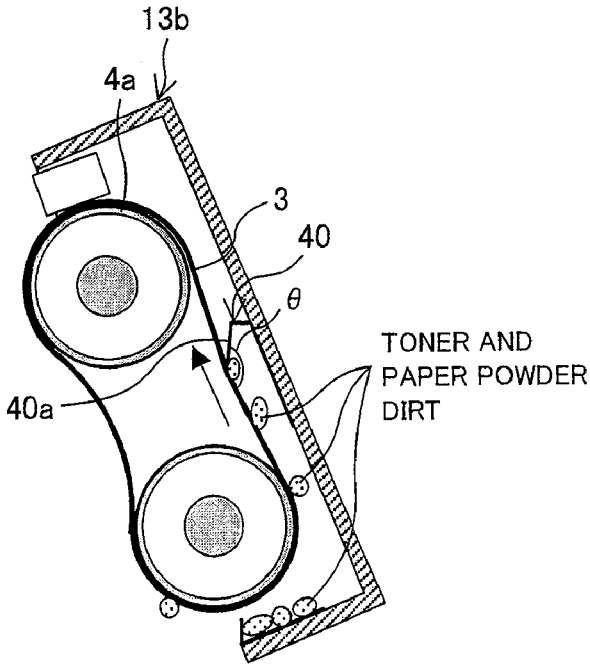
FIG. 8
Figure 9:
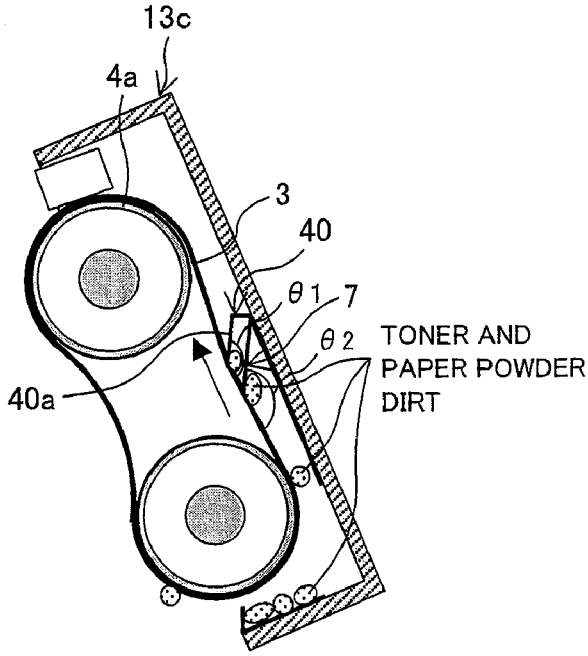
FIG. 9
Figure 10:
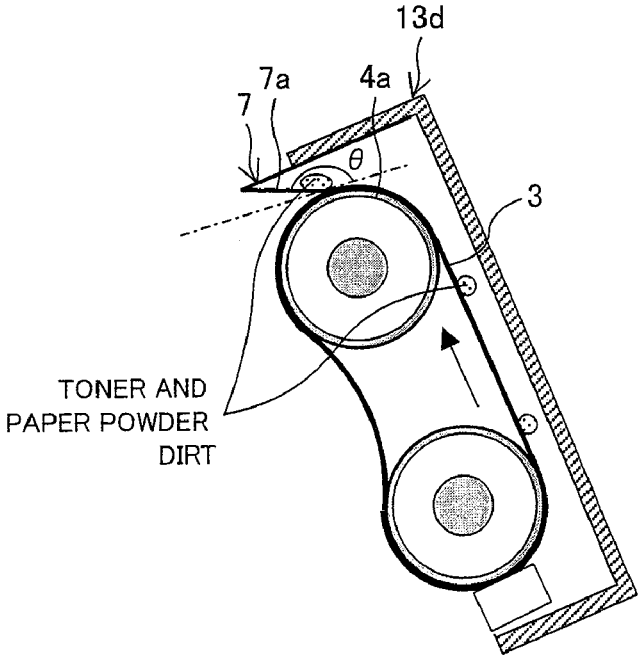
FIG. 10

This experiment was carried out on five types of external heating units, i.e., the external heating unit 13 (Example 1) illustrated in FIG. 4, an external heating unit 13*a* (Example 2) illustrated in FIG. 7, an external heating unit 13*b* (Example 3) illustrated in FIG. 8, an external heating unit 13*c* (Example 4) illustrated in FIG. 9, and an external heating unit 13*d* (Comparative Example) illustrated in FIG. 10, in order to examine (i) cleaning performance, (ii) a change in a surface roughness (an average roughness Ra with respect to a center line) of an external heating belt which change was caused by aging, and (iii) presence or absence of slippage of the external heating belt 3 with respect to the fixing roller 1.

Example 2 has the same configuration as that of Example 1, except that, in Example 2, a contacting direction in which a cleaning section 7*a* of a scraper 7 is in contact with an external heating belt 3 corresponds to the "with direction", specifically, a contacting angle at which the cleaning section 7*a* is in contact with the external heating belt 3 is set to θ=30°.

Example 3 includes a scraper 40 in place of the scraper 7 of Example 1. The scraper 40 is a plate member which is made of stainless steel having a thickness of 0.3 mm and is bent at two bending portions substantially parallel to each other. That is, the scraper 40 has substantially the same configuration as that of the scraper 7 of Example 1, except that the scraper 40 is bent at two positions (to have a substantially C-shape) whereas the scraper 7 is bent at one position. A contacting angle at which a cleaning section 40*a* is in contact with an external heating belt 3 is set to θ=150°, and a pushed amount d for which an external heating belt 3 is pushed down is set to 0.6 mm.

Example 4 has substantially the same configuration as that of Example 1, except that Example 4 includes the scraper 40 of Example 3 in addition to the scraper 7 of Example 1. The scraper 7 and the scraper 40 are in contact with an external heating belt 3 in a region corresponding to a common tangent line extending between external heating rollers 4*a* and 4*b*. The scraper 7 is in contact with the external heating belt 3 on an upstream side (in a rotational direction of the external heating belt 3) of the scraper 40. A pushed amount d for which the scraper 7 pushes down the external heating belt 3 is set to 0.3 mm, and a pushed amount d for which the scraper 40 pushes down the external heating belt 3 is set to 0.6 mm. A contacting angle θ1 at which the scraper 7 is in contact with the external heating belt 3 is set to θ1=150°, and a contacting angle θ2 at which the scraper 40 is in contact with the external heating belt 3 is set to θ2=150°.

Comparative Example has the same configuration as that of Example 1, except that, in Comparative Example, a cleaning section 7*a* of a scraper 7 is in contact with an external heating belt 3 in a region where an inner surface of an external heating belt 3 is in contact with a heating roller 4*a*.

In order to evaluate the cleaning performance, a printing aging test using 120K (one hundred and twenty thousands) sheets was carried out under the condition that a printing rate of each color (K, Y, M, C) on a manuscript was 5% i.e., a total printing rate was 20%, and then two types of image defects (a spotted image and a liner-missing image in a printed image on a sheet) caused by poor cleaning were evaluated. The spotted image is an image defect usually caused in such a manner that toner dirt which once has been scraped off by a scraper passes by the scraper and a recording sheet is stained with the toner dirt. The spotted image was evaluated by counting, out of every 20K sheets, the number of recording sheets having a spotted image. The liner-missing image is a linear image defect (which is noticeable especially in a case where printing is carried out on a thick sheet) usually caused in such a manner that paper powder dirt which once has been scraped off by a scraper passes by the scraper, sticks to a surface of an external heating belt, and scratches a surface of a fixing roller. The liner-missing image was evaluated by visually observing an extent (level) of liner-missing image every 20K sheets. Specifically, based on the result of the visual inspection, the liner-missing image was classified into (i) a level (excellent) at which no scratch was found even on a thick sheet, (ii) a level (satisfactory) at which a small scratch was found on a thick sheet but it did not matter, (iii) a level (moderate) at which a noticeable scratch was found on a thick sheet but it did not matter with a recording sheet which is not a thick sheet, or (iv) a level (poor) at which a noticeable scratch was found even on a recording sheet which is not a thick sheet.

In order to examine the change in the surface roughness (the average roughness (Ra) with respect to the center line) of the external heating belt 3 which change was caused by the aging, a surface roughness of the external heating belt 3 having been subjected to the printing aging test using 120K (one hundred and twenty thousands) sheets was measured with use of a surface roughness measuring instrument of a probing method "SE-3500" manufactured by Kosaka Laboratory Ltd. In order to determine the presence or absence of slippage, it was visually checked whether or not the external heating belt 3 slipped with respect to the fixing roller 1 during the aging test.

FIG. 13 shows the results of the foregoing experiments.

FIG. 13 shows that, in Comparative Example, image defects (a spotted image and a liner-missing image) occurred due to poor cleaning at an early stage of the aging test, and the level of image defect deteriorated as the number of sheets used in the aging test increased. A surface roughness Ra of the external heating belt 3 having been subjected to the aging test was 12 μm, which was far greater than a surface roughness Ra (0.5 μm) measured at the early stage of the aging test. Further, the external heating belt 3 slipped with respect to the fixing roller 1 at the early stage of the aging test.

These are considered to have happened because of the following reason: As illustrated in FIG. 10, the scraper 7 is in contact with the external heating belt 3 in the region where the inner surface of the external heating belt 3 is in contact with the heating roller 4*a*. Therefore, it is difficult for the scraper 7 to be in contact with the external heating belt 3 uniformly (without any gap) in the width direction (a direction perpendicular to the rotational direction of the external heating belt 3) due to restrictions such as the processing accuracy of the tip of the scraper 7 and/or the installation accuracy of the scraper 7. Thus, toner dirt is partially allowed to pass through a gap created between the scraper 7 and the external heating belt 3.

In addition, the following reason is also considered: Since the heating roller 4*a* is in contact with the inner surface of the external heating belt 3 in the region where the scraper 7 and the external heating belt 3 are in contact with each other, a contacting pressure of the scraper 7 against the external heating belt 3 becomes higher, and accordingly a great friction force is applied to the external heating belt 3. Due to this, the external heating belt 3 easily slips and/or has a scratch on its surface (outer surface). Note that, with the configuration in which the scraper 7 is in contact with the external heating belt 3 in the region where the inner surface of the external heating belt 3 is in contact with the heating roller 4*a*, it is difficult to secure the scraper 7 with a high accuracy while the contacting pressure of the scraper 7 is set to be low.

Upon occurrence of slippage of the external heating belt 3 with respect to the fixing roller 1, the amount of heat supplied from the external heating belt 3 to the fixing roller 1 decreases, and this makes it difficult to maintain the fixing roller 1 at the predetermined fixing temperature. This reduces the fixing performance of toner, and accordingly the amount of toner transferred from a recording sheet to the fixing roller 1 increases. Further, upon occurrence of slippage of the external heating belt 3 with respect to the fixing roller 1, the surface of the fixing roller 1 is apt to be scratched and sustain the adhesion of toner dirt. Furthermore, in the case where the surface roughness of the external heating belt 3 becomes higher, the cleaning performance with respect to toner adhered to the external heating belt 3 is impaired, and accordingly toner dirt more easily adheres to the external heating belt 3. Consequently, an extent of a toner stain on the fixing roller 1 is increased. This leads to an image defect caused by poor cleaning of the fixing roller 1.

On the other hand, as illustrated in FIG. 13, image defects caused by poor cleaning were significantly reduced in Examples 1 to 4, as compared with Comparative Example. Particularly in Example 4, no image defect occurred during the aging test of 120K sheets. Further, in Examples 1 to 4, the respective surface roughnesses Ra of the external heating belts 3 having been subjected to the aging test were within a range from 1 μm to 3 μm, and these were significantly smaller than that (surface roughness Ra: 12 μm) in Comparative Example. Furthermore, in Examples 1 to 4, the external heating belt 3 did not slip with respect to the fixing roller 1.

The reason for these is considered as follows: In Examples 1 to 4, the scraper 7 is in contact with the external heating belt 3 in the region where the inner surface of the external heating belt 3 is not in contact with the heating roller 4*a* i.e., the region where the external heating belt 3 is free and the movement of the external heating belt 3 in a direction perpendicular to the surface of the external heating belt 3 is not restricted. Therefore, even in a case where the processing accuracy and/or the installation accuracy of the scraper 7 is low in some degree, the external heating belt 3 is in contact with the scraper 7 (cleaning section 7*a*) tightly and flexibly according to the shape of the tip of the scraper 7. This does not create a gap between the tip of the scraper 7 and the external heating belt 3. As a result, it is possible to prevent toner dirt on the external heating belt 3 from partially passing by the scraper 7, whereas this happened in Comparative Example.

In addition, the following reason is also considered: In Examples 1 to 4, since the scraper 7 is in contact with the external heating belt 3 in the region where the inner surface of the external heating belt 3 is not in contact with the heating roller 4*a*, it is possible to prevent an increase in the contacting pressure of the scraper 7 against the external heating belt 3. This reduces a load (a friction force applied by the scraper 7) against the rotation of the external heating belt 3, and accordingly prevents (i) slippage of the external heating belt 3 with respect to the fixing roller 1 and (ii) a scratch on the surface of the external heating belt 3. Thus, it is possible to prevent occurrence of an image defect caused by poor cleaning.

As illustrated in FIG. 13, the frequency of occurrence of poor cleaning was less in the case where the scraper 7 was in contact with the external heating belt 3 in the counter direction with respect to the rotational direction of the external heating belt 3 (Example 1), as compared with the case where the scraper 7 was in contact with the external heating belt 3 in the "with direction" (Example 2). The following is considered as a reason for this: In the case where the scraper 7 is in contact with the external heating belt 3 in the "with direction", toner dirt which has been scraped off may accumulate at the contacting point at which the external heating belt 3 and the scraper 7 are in contact with each other, the accumulated toner may push up the scraper 7 so as to create a gap between the external heating belt 3 and the scraper 7, and toner may pass through the gap. Further, in the case where the scraper 7 is in contact with the external heating belt 3 in the "with direction", the following problem may occur: When the temperature of each part of the fixing apparatus 30 decreases after a power source is turned off, toner dirt sticks to both of the external heating belt 3 and the scraper 7, and therefore a greater rotational load is required to rotate the external heating belt 3 again. On the other hand, in the case where the scraper 7 is in contact with the external heating belt 3 in the counter direction, toner dirt scraped off by the tip of the cleaning section 7*a* of the scraper 7 is brought up to a side surface of the cleaning section 7*a*. Therefore, it is possible to prevent the accumulation and the sticking of toner at the contacting point at which the external heating belt 3 and the scraper 7 are in contact with each other.

Further, as illustrated in FIG. 13, the frequency of occurrence of liner-missing image and/or the like was less in the case of using the scraper 40 (Example 3), which had a shape bent at two positions, as compared with the case of using the scraper 7 (Example 1), which had a shape bent at one position. Here, the scraper 40 (Example 3) is made of the plate member bent at two bending portions parallel to each other, and the scraper 7 (Example 1) is made of the plate member bent at one bending portion.

Figure 11:
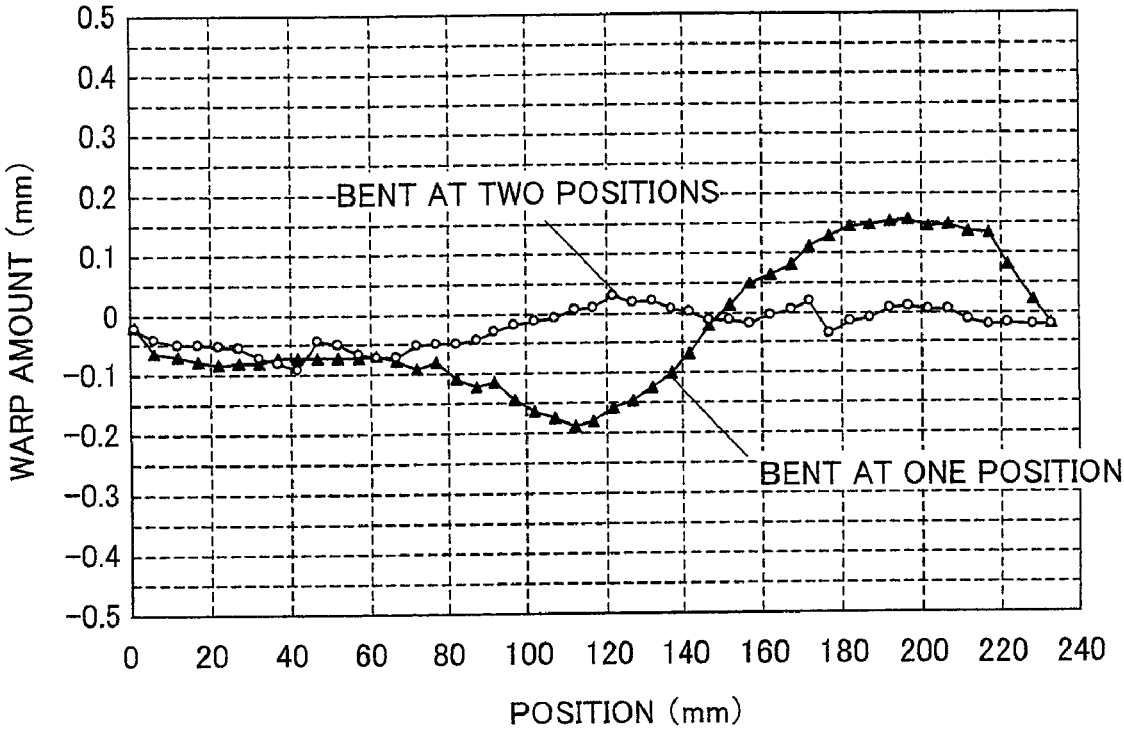
FIG. 11

The reason for this is described below with reference to FIG. 11. With respect to the edges of the scraper 7 and the scraper 40 each of which edges were in contact with the external heating belt 3, the respective straightnesses (warp amounts) were measured in the width direction of the external heating belt 3 by means of a laser scan micrometer "LSM-406R/3000" manufactured by Mitutoyo Corporation. FIG. 11 is a view illustrating the plotted results of the measurements carried out for respective positions in the width direction of the external heating belt 3. As illustrated in FIG. 11, the scraper 7, which had the shape bent at one position, had a total warp amount (i.e., a difference between a maximum warp amount and a minimum warp amount) of approximately 0.35 mm. On the other hand, the scraper 40, which had the shape bent at two positions, had a total warp amount of approximately 0.125 mm. This shows that the scraper 40, which has the shape bent at two positions, has a more excellent straightness than the scraper 7, which has the shape bent at one position. This is because of the following reason: In a case where the number of bending is increased, an area of a plate-shaped portion (flat surface portion) of the cleaning section

40*a* is reduced. With this, an extent of warp and deformation of the flat surface portion caused while the scraper is processed (e.g., bend) becomes smaller. This improves the dimensional accuracy (straightness) of the edge of the scraper. Therefore, as compared with the scraper 7, which has the shape bent at one position, the scraper 40, which has the shape bent at two positions, allows the edge of the scraper to more uniformly be in contact with the external heating belt 3 in the width direction of the external heating belt 3, and accordingly to more surely prevent the scraped dirt from partially passing through a gap between the scraper and the external heating belt 3.

Further, as illustrated in FIG. 13, fewer liner-missing images were found in the case where two scrapers were provided (Example 4) than in the case where one scraper was provided (Example 1, Example 3). This is because of the following reason: With two scrapers, even in a case where dirt passes by a scraper provided on the upstream side in the rotational direction of the external heating belt 3, the dirt can be collected by the other scraper provided on the downstream side.

Note that, in a case where a plurality of scrapers are made to be in contact with an external heating belt 3 in order along a rotational direction of the external heating belt 3, it is preferable that the shapes and the installation positions of the respective scrapers are set so that the scrapers being in contact with the external heating belt 3 at more downstream contacting points in the rotational direction of the external heating belt 3 are pressed against the external heating belt 3 with greater pushed amounts. With this configuration, dirt which has passed by a scraper provided on the upstream side in the rotational direction can be removed by another scraper which is provided on the downstream side in the rotational direction and which has a larger contacting pressure against the external heating belt 3. This makes it possible to more surely prevent dirt from passing by a scraper.

Embodiment 2

The following describes another embodiment of the present invention. For convenience of explanation, members having the same function as those of Embodiment 1 are given the same signs as Embodiment 1, and the explanations thereof are omitted here.

Described in Embodiment 1 is the case where the present invention is applied to an external belt heat type fixing apparatus. On the other hand, the present embodiment describes a case where the present invention is applied to a belt fixing type fixing apparatus.

Figure 12:
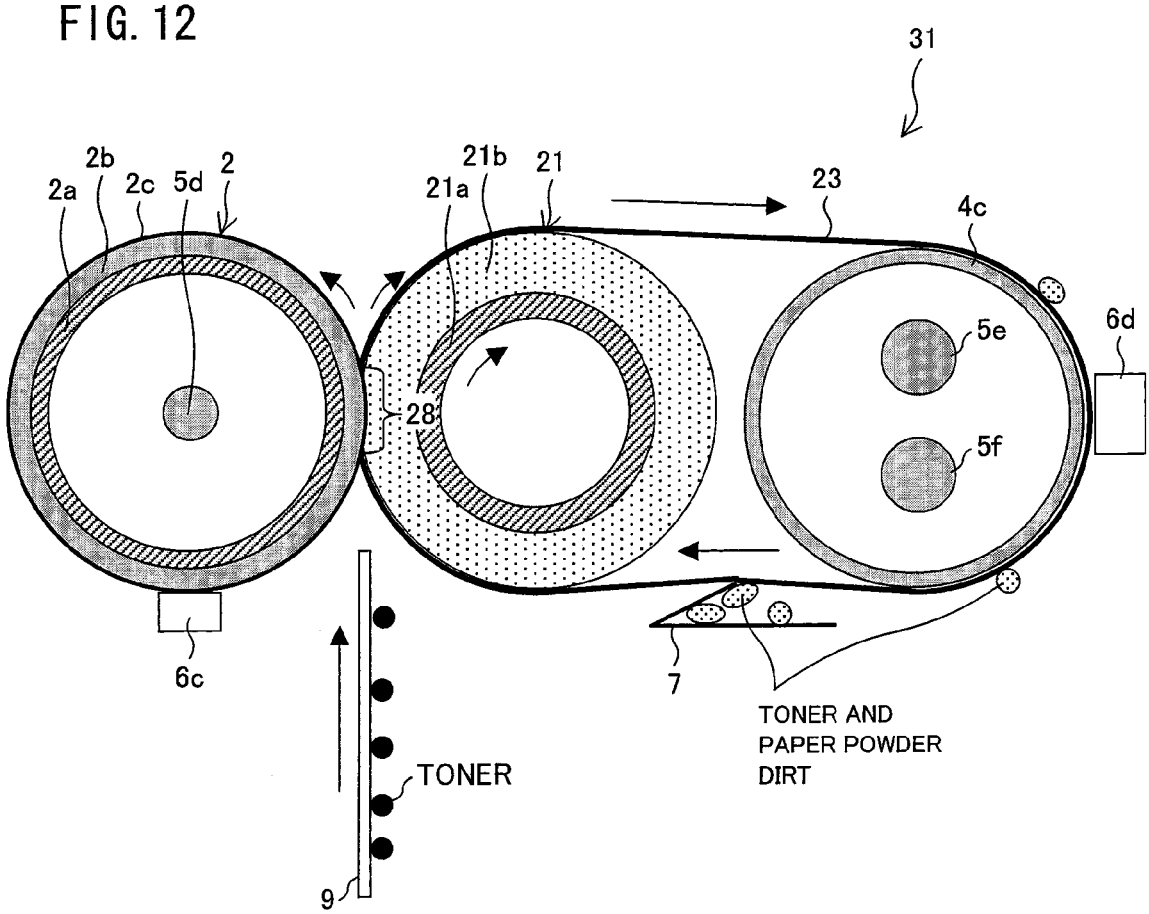
FIG. 12

FIG. 12 is a cross-sectional view illustrating the configuration of a fixing apparatus 31 according to the present embodiment. This fixing apparatus 31 is provided in place of the fixing apparatus 30 in the image forming apparatus 100.

As illustrated in FIG. 12, the fixing apparatus 31 includes a fixing roller (fixing member) 21, a pressure roller (pressure member) 2, a heating roller (suspending roller) 4*c*, and a fixing belt (endless belt) 23 which is endless. The fixing roller 21, the heating roller 4*c*, and the fixing belt 23 constitute an external heating device.

The fixing roller 21 is rotated by rotating means (not illustrated) in a direction indicated by the arrow in FIG. 12. The fixing roller 21 has a two-layer configuration including: a core metal 21*a* made of metal; and an elastic layer 21*b* covering an outer peripheral surface of the core metal 21*a*. In the present embodiment, a traveling speed of a surface of the fixing roller 21 i.e., a fixing speed (process speed) is set to 225 mm/sec. This allows for image formation at a copying speed (printing speed) of 40 sheets/min.

The core 21*a* is made of stainless steel shaped in a cylindrical column having a diameter of 15 mm. Note that the material of the core 21*a* is not limited to stainless steel, but may be, for example, a metal such as iron, aluminum, or copper or an alloy of such metals. The shape of the core 21*a* is not limited to a cylindrical column, but may be, for example, a hollow cylinder. The elastic layer 21*b* is made of silicon sponge rubber (silicon rubber) having a thickness of 7.5 mm. Note that the material of the elastic layer 21*b* is not limited to silicon rubber. Examples of the material of the elastic layer 21*b* encompass other rubber materials such as fluorine-containing rubber and various kinds of elastic materials.

The pressure roller 2 is pressed against the fixing roller 21 via the fixing belt 23 at a predetermined load (in the present embodiment, 216 N) by pressure member (not illustrated) such as a spring. This forms a fixing nip area 28 (in the present embodiment, a fixing nip width (the width of the fixing nip area 28 in a direction in which a recording sheet 9 is carried): 8 mm) between the pressure roller 2 and the fixing belt 23. The pressure roller 2 is rotated by the fixing belt 23, and has a three-layer configuration in which a core 2*a*, an elastic layer 2*b*, and a releasing layer 2*c* are formed in this order from the inside.

In the present embodiment, the pressure roller 2 includes: the core 2*a* which is made of iron (STKM), shaped in a hollow cylinder, and has a diameter of 24 mm and a thickness of 2 mm; the elastic layer 2*b* which is formed on the core 2*a* and is made of silicon solid rubber having a thickness of 3 mm; and the releasing layer 2*c* which is formed on the elastic layer 2*b* and is made of a PFA tube having a thickness of 30 μm. Note that the configuration of the pressure roller 2 is not limited to this. Instead of this, for example, the pressure roller 2 may use a core 2*a* made of a metal such as stainless steel, aluminum, or copper, or an alloy of such metals. Further, the elastic layer 2*b* may be made of a heat-resistive rubber material or elastic body (e.g., fluorine-containing rubber). Furthermore, the releasing layer 2*c* may use other fluororesin such as PTFE (polytetrafluoroethylene).

For an outer peripheral surface of the pressure roller 2, a thermistor 6*c* is provided which detects the temperature of the outer peripheral surface. The pressure roller 2 internally includes a heater lamp 5*d* for heating the pressure roller 2. The heater lamp 5*d* is a heat source for the pressure roller 2. A control section (not illustrated) controls electric power supplied from a power source circuit (not illustrated) to the heater lamp 5*d* so as to cause the heater lamp 5*d* to radiate an infrared ray. Thus, an inner peripheral surface of the pressure roller 2 is heated.

The heating roller 4*c* suspends the fixing belt 23 together with the fixing roller 21. The heating roller 4*c* is shaped in a hollow cylinder having a diameter of 30 mm. The hollow cylinder is made of an aluminum core material having a thickness of 0.75 mm on which aluminum core material a PTFE coating having a thickness of 20 μm is applied. Note that the configuration of the heating roller 4*c* is not limited to this. Instead of this, for example, the heating roller 4*c* may use a core material made of an iron material which is not aluminum. In the present embodiment, the PTFE coating is applied to the surface of the heating roller 4*c* so that a deviation force (a force which causes the fixing belt 23 to move in a rotational axis direction (a direction of the width of the fixing belt 23) while the fixing belt 23 is rotating) of the fixing belt 23 is reduced. However, the present invention is not limited to this.

Instead of this, for example, a coating of other fluororesin such as PFA may be applied, or the coating may be omitted.

The heating roller 4*c* internally includes heater lamps 5*e* and 5*f* each of which radiates heat in response to electric power supplied thereto. Each of the heater lamps 5*e* and 5*f* is a heat source for the heating roller 4*c*. The control section (not illustrated) controls electric power supplied from the power source circuit (not illustrated) to the heater lamps 5*e* and 5*f*, so as to cause the heater lamps 5*e* and 5*f* to emit light and thereby to radiate an infrared ray. The heating roller 4*c* absorbs the infrared ray emitted from the heater lamps 5*e* and 5*f* and then is heated. This causes the fixing belt 23 suspended by the heating roller 4*c* to be heated. The heating roller 4*c* is rotated by the fixing belt 23.

The fixing belt 23 is an endless belt which is suspended by the fixing roller 21 and the heating roller 4*c* under tension and which is rotated by the fixing roller 21. Further, as described above, the fixing roller 21 and the pressure roller 2 are pressed against each other via the fixing belt 23. This forms the fixing nip area 28 between the fixing belt 23 and the pressure roller 2. The fixing apparatus 31 fixes an unfixed toner image on a recording sheet 9 in such a manner that the recording sheet 9 whose surface has the unfixed toner image is passed through a nip between the fixing belt 23 and the pressure roller 2. Here, the surface of the recording sheet 9 on which surface the unfixed toner image is formed comes in contact with the fixing belt 23, and the other surface of the recording sheet 9 which surface is opposite to the surface on which the unfixed toner image is formed comes in contact with the pressure roller 2.

In the present embodiment, the fixing belt 23 includes a substrate which is made of polyimide having a thickness of 70 μm; an elastic layer which is formed on the substrate and is made of silicon rubber having a thickness of 150 μm; and a releasing layer which is formed on the elastic layer and is made of a PFA tube having a thickness of 30 μm. The size of the fixing belt 23 is set to have a diameter of 50 mm (the length of the circumference: approximately 157 mm) in a state that the fixing belt 23 forms a circle.

Note that the configuration of the fixing belt 23 is not limited to this. Instead of this, for example, the fixing belt 23 may use a substrate shaped in a hollow cylinder and made of heat-resistive resin (except for polyimide) or a metal material such as stainless steel or nickel. Further, fluororesin may be internally added (added) to the substrate so that a sliding load generated between the fixing belt 23 and the heating roller 4*c* is reduced. Note that the material of the elastic layer is not limited to silicon rubber, but only needs to be an elastomeric material excellent in heat resistance and elasticity. Note that the material of the releasing layer only needs to be a material excellent in heat resistance and releasability. The material of the releasing layer is not limited to PFA. Instead of this, for example, the material of the releasing layer may be a synthetic resin material containing fluororesin (e.g., PTFE).

A thermistor 6*d* and a scraper (cleaning member) 7 are provided for an outer peripheral surface of the fixing belt 23. The thermistor 6*d* detects the temperature of the outer peripheral surface of the fixing belt 23, and the scraper 7 removes toner and/or paper powder adhered to the outer peripheral surface of the fixing belt 23. The control section controls, in accordance with the temperature detection results obtained by the thermistors 6*c* and 6*d*, electric power supplied to the heater lamps 5*d* and 5*e* so that the temperatures of the fixing belt 23 and the pressure roller 2 become close to or maintain predetermined temperatures, respectively.

The shape and the material of the scraper 7 are the same as those of Embodiment 1. The scraper 7 is provided such that a cleaning section 7*a* of the scraper 7 is in contact with an outer surface of the fixing belt 23 in a counter direction with respect to a rotational direction of the fixing belt 23. The position at which the cleaning section 7*a* is in contact with the outer surface of the fixing belt 23 is on an upstream side (in the rotational direction of the fixing belt 23) of the fixing nip area 28, and is in a region where an inner surface of the fixing belt 23 is not in contact with the fixing roller 21 and the heating roller 4*c* (i.e., a region the fixing belt 23 is free). Note that a supporting section 7*b* of the scraper 7 is fixed to a housing (not illustrated) of the fixing apparatus 31. Further, a toner receiver (not illustrated; a containing member) for storing toner and/or paper powder that the scraper 7 has removed from the fixing belt 23 is provided below the scraper 7.

Note that, it is preferable that the scraper 7 is provided below the fixing belt 23 or is provided in side-by-side relationship with the fixing belt 23. This prevents the following case: Toner and/or the like that the scraper 7 has removed from the fixing belt 23 drops from the scraper 7 and adheres to the fixing belt 23 again, so that the fixing belt 23 is stained.

As described above, in the fixing apparatus 31 according to the present embodiment, the scraper 7 for cleaning up the surface of the fixing belt 23 is in contact with the outer surface of the fixing belt 23 in the region where the inner surface of the fixing belt 23 is not in contact with the fixing roller 21 and the heating roller 4*c*.

This reduces a sliding force generated between the cleaning member and the fixing belt, as compared with the conventional configuration in which a cleaning member is in contact with a fixing belt in a region where the fixing belt is suspended by a suspending roller. This prevents the fixing belt from being scratched due to sliding between the cleaning member and the fixing belt, and also prevents an increase in a load applied in a direction which hinders the rotation of the fixing belt, so that slippage of the fixing belt with respect to the fixing roller is prevented.

The present invention may be applied to a fixing apparatus for use in an electrophotographic image forming apparatus.

In order to solve the foregoing problems, a fixing apparatus of an embodiment of the present invention includes: a fixing roller; a pressure member for applying pressure against the fixing roller; an endless belt which is rotatably supported and heats the fixing roller by being in contact with a surface of the fixing roller; and heating means for heating the endless belt, by passing a recording material through a nip between the fixing roller and the pressure member, said fixing apparatus fixing an unfixed toner image on the recording material on which the unfixed toner image is transferred, said fixing apparatus further including; a cleaning member for removing dirt adhered to a surface of the endless belt by being in contact with the surface of the endless belt in a region where the endless belt is not supported.

This configuration includes the cleaning member for removing the dirt adhered to the surface of the endless belt by being in contact with the surface of the endless belt in the region where the endless belt is not supported. This reduces a sliding load generated between the cleaning member and the endless belt, as compared with the conventional configuration in which a cleaning member is in contact with an endless belt in a region where the endless belt is supported by a suspending roller. This prevents the endless belt from being scratched due to sliding between the cleaning member and the endless belt, and also prevents a load applied in a direction which hinders the rotation of the endless belt, so that slippage of the endless belt is prevented.

In an embodiment, the cleaning member may be a scraper including a plate member having an edge being in contact with the surface of the endless belt so that the dirt adhered to the surface of the endless belt is removed.

With this configuration, it is possible to remove the dirt adhered to the surface of the endless belt by causing the edge of the scraper to be in contact with the endless belt in a region where the movement of the endless belt in a direction perpendicular to the surface of the endless belt is not restricted. Therefore, since the edge of the scraper is in contact with the endless belt flexibly and tightly regardless of the processing accuracy or the installation accuracy of the scraper, it is possible to favorably remove dirt such as toner adhered to the endless belt. Further, this simplifies the configuration of the cleaning member as compared with a configuration in which a cleaning web or the like is used as the cleaning member, thereby making it possible to reduce the size of the fixing apparatus. Furthermore, this solves a problem occurred in a case where the cleaning web is used as the cleaning member i.e., a problem that silicon oil contained in the cleaning web impairs the releasability of a recording material.

Further, an embodiment may be configured such that: the endless belt is suspended and supported by a plurality of suspending rollers; an outer surface of the endless belt is in contact with the fixing roller, the outer surface being on a side not being in contact with the plurality of suspending rollers.

According to this configuration, by causing the outer surface of the endless belt to be in contact with the fixing roller, it is possible to heat the surface of the fixing roller. Further, this configuration allows the cleaning member to remove dirt such as toner transferred from the fixing roller to the endless belt. Furthermore, dirt such as toner adhered to the fixing roller can be transferred to the endless belt, and the dirt such as toner thus transferred to the endless belt can be removed by the cleaning member. Thus, it possible to clean up the surface of the fixing roller by means of the endless belt. Therefore, it is possible to omit or simplify the cleaning member for cleaning up the surface of the fixing roller.

Moreover, an embodiment may be configured such that: the endless belt is suspended and supported by the fixing roller and at least one suspending roller; the pressure member applies pressure against the fixing roller via the endless belt; the unfixed toner image is fixed on the recording material in such a manner that the recording material on which the unfixed toner image is transferred is passed through a nip between the pressure member and an outer surface of the endless belt which outer surface is on a side not being in contact with the fixing roller.

With this configuration, it is possible to heat the surface of the fixing roller by causing the inner surface of the endless belt to be in contact with the fixing roller, and accordingly to fix toner on the recording material by the heat transferred from the fixing roller via the endless belt. Further, it is possible to remove dirt such as toner transferred from the recording material to the endless belt by means of the cleaning member.

Furthermore, in an embodiment, the scraper may be made of metal.

According to this configuration, by using the scraper made of metal, it is possible to improve the processing accuracy of the scraper. This allows the edge of the scraper to be in contact with the endless belt uniformly. Thus, it is possible to more favorably remove dirt such as toner adhered to the surface of the endless belt. Further, it is possible to reduce a friction force (sliding load) which is generated by the contact between the scraper and the endless belt and which acts on the endless belt. This prevents a scratch on the endless belt and slippage of the endless belt.

Moreover, an embodiment may be configured such that: the scraper includes: a bending portion at which the plate member is bent; a cleaning section which is a part of the plate member from the edge to the bending portion; and a supporting section which is a part of the plate member from the bending portion to another edge of the plate member, the supporting section being fixed to a housing of the fixing apparatus, the bending portion having an opening which cuts in the plate member in a direction intersecting a direction in which a straight line made by the bending portion elongates.

With this configuration, even in a case where the scraper is heated by heat generated in the endless belt and deformed due to its thermal expansion, the opening absorbs the deformation caused by the thermal expansion. This prevents the following case: Due to the thermal expansion, the edge of the scraper is deformed to have a wavy shape or the like which causes the scraper not to be in contact with the endless belt tightly and uniformly, and dirt such as toner passes through a gap created between the scraper and the endless belt. Because such the case is prevented, it is possible to more effectively clean up the surface of the endless belt, and accordingly to prevent occurrence of an image defect caused by dirt such as toner adhered to the endless belt.

Furthermore, an embodiment may be configured such that: the scraper includes: a plurality of bending portions at which the plate member is bent, the plurality of bending portions being parallel to each other; a cleaning section which is a part of the plate member from the edge to the plurality of bending portions; and a supporting section which is a part of the plate member from the plurality of bending portions to another edge of the plate member, the supporting section being fixed to a housing of the fixing apparatus.

According to this configuration, by providing the plurality of bending portions, it is possible to reduce an area of each flat surface portion of the scraper, and accordingly to improve the rigidity of the scraper. This prevents the scraper from being warped or deformed while the scraper is being processed (e.g., bent), and accordingly improves the dimensional accuracy (straightness) of the edge of the scraper. Thus, it is possible to cause the edge of the scraper to be in contact with the endless belt in a substantially uniform manner. This prevents such a case that a gap is partially created between the scraper and the endless belt and the dirt which once has been scraped off passes through the gap between the scraper and the endless belt.

Moreover, an embodiment may be configured such that: a plurality of said scrapers are arranged in such a manner that the plurality of said scrapers are in contact with the endless belt in order along a rotational direction of the endless belt.

With this configuration, even if dirt which once has been scraped off by a scraper on an upstream side in the rotational direction of the endless belt passes through a gap between the scraper and the endless belt, it is possible to collect the dirt by means of another scraper on a downstream side in the rotational direction. Thus, it is possible to more appropriately remove dirt on the endless belt.

Furthermore, an embodiment may be configured such that: the scrapers being in contact with the endless belt at more downstream contacting points in the rotational direction of the endless belt are pressed against the endless belt with greater pushed amounts, each of the pushed amounts being a distance for which the endless belt is pushed down at the respective contacting point at which the respective scraper is pressed against the endless belt.

With this configuration, the scrapers being in contact with the endless belt at more downstream contacting points in the rotational direction of the endless belt are pressed against the endless belt with greater pushed amounts. This allows the respective scrapers to be in contact with the endless belt surely. Therefore, even in a case where dirt which once has been scraped off by a scraper on the upstream side in the rotational direction of the endless belt passes through a gap between this scraper and the endless belt, it is possible to remove the dirt by another scraper on the downstream side in the rotational direction. This makes it possible to more favorably remove dirt on the endless belt.

In a fixing apparatus of an embodiment of the present invention, a surface of the scraper may be coated with a coating made of fluororesin.

With this configuration, it is possible to prevent dirt such as toner from being accumulated on the edge of the scraper. This prevents such a case that the scraper is pushed up by accumulated toner so that a gap is created between the endless belt and the scraper and dirt such as toner passes through the gap. Further, this prevents such a case that dirt such as toner accumulated on the edge of the scraper applies a local load to the edge of the scraper. Because such the case is prevented, the life of the scraper is elongated.

Further, in an embodiment, the coating may be made of a material different from a surface layer material for the surface of the endless belt which surface is in contact with the scraper.

With this configuration, the affinity between the surface layer of the scraper and the surface layer of the endless belt is increased. This prevents an increase in a friction coefficient between the scraper and the endless belt, and accordingly prevents slippage of the endless belt. Further, this also prevents the scraper from being dragged and deformed by the rotation of the endless belt due to a friction force.

Furthermore, an embodiment may be configured such that: a contacting angle is greater than 90°, the contacting angle being an angle made by (i) a part of the surface of the endless belt which part extends, toward an upstream of the rotational direction of the endless belt, from a contacting point at which the endless belt and the scraper are in contact with each other and (ii) a surface of the scraper which surface faces the upstream of the rotational direction of the endless belt and includes said contacting point.

In a case where the contacting angle is smaller than 90 degrees, dirt such as toner scraped off by the scraper may accumulate at the a contacting point at which the endless belt and the scraper are in contact with each other. The accumulated toner may push up the scraper so as to create a gap between the endless belt and the scraper, and dirt such as toner may pass through the gap. Further, in the case where the contacting angle is smaller than 90 degrees, dirt such as toner may stick to the contacting point at which the endless belt and the scraper are in contact with each other, so as to hinder the rotation of the endless belt. On the other hand, with the above-mentioned configuration, dirt such as toner scraped off by the scraper is brought up to a surface of the scraper. This prevents the dirt such as toner from being accumulated on the edge of the scraper. Thus, it is possible to prevent dirt such as toner from passing through a gap between the endless belt and the scraper. This prevents impairment in the cleaning performance, and also prevents the following case: Dirt such as toner sticks to the contacting point at which the endless belt and the scraper are in contact with each other, and the stuck dirt such as toner hinders the rotation of the endless belt.

Moreover, in an embodiment, the contacting angle may be within a range of 135° or greater but not greater than 165°.

According to this configuration, by setting the contacting angle to 135° or greater, it is possible to prevent the edge of the scraper from being dragged and deformed by the rotation of the endless belt. Further, by setting the contacting angle to 165° or smaller, it is possible to prevent the following case: The scraper and the endless belt are in contact with each other almost in a surface contact manner, and accordingly dirt such as toner on the endless belt cannot be scraped favorably, so that the cleaning performance is impaired.

Further, in an embodiment, a pushed amount for which the scraper pushes down the endless belt may be 0.3 mm or more but not more than 1 mm, the pushed amount being a distance for which the endless belt is pushed down at a contacting point at which the scraper is pressed against the endless belt.

If the pushed amount is too small, the pressing force of the scraper against the endless belt is weak. Therefore, for example, in a case where the endless belt rotates while being corrugated, there may be a case where the edge of the scraper cannot be in contact with the endless belt in a width direction of the endless belt uniformly. If the pushed amount is too large, the pressing force of the scraper against the endless belt is great. This may cause a case where the endless belt is damaged (scratched) or a case where the endless belt slips due to an increase in a load applied in a direction which hinders the rotation of the endless belt. In contrast to these, with the above-mentioned configuration, by setting the pushed amount for which the scraper pushes down the endless belt to 0.3 mm or more but not more than 1 mm, it is possible to cause the edge of the scraper to be in contact with the endless belt uniformly in the width direction of the endless belt, and also to prevent (i) a damage caused to the endless belt due to the scraper's contact with the endless belt and (ii) slippage of the endless belt.

Furthermore, in an embodiment, in the configuration where the outer surface of the endless belt is in contact with the fixing roller, the outer surface of the endless belt may be made of a same material as that for the surface of the fixing roller.

With this configuration, since the temperature of the endless belt is higher than that of the fixing roller, it is possible to transfer, to endless belt, toner adhered to the fixing roller. Further, with this configuration, it is possible to reduce the amount of toner transferred from the fixing roller to the endless belt, as compared with a configuration in which an outer surface of an endless belt is made of a material having a lower toner releasability than that of a surface of a fixing roller. Therefore, it is possible to prevent the following case: An excess amount of toner is adhered to the cleaning member, and the subsequent cleaning is made to be difficult to be performed.

Moreover, in an embodiment, in the configuration where the outer surface of the endless belt is in contact with the fixing roller, the outer surface of the endless belt may be made of a material having a lower toner releasability than that of the surface of the fixing roller.

With this configuration, it is possible to prevent toner adhered to the endless belt from transferring to the fixing roller, and accordingly to prevent occurrence of an image defect due to adhesion of toner to the fixing roller.

Furthermore, an embodiment may further include a containing member, provided below the cleaning member, for storing the dirt that the cleaning member has removed from the endless belt.

With this configuration, it is possible to store, in the containing member, dirt such as toner removed by the cleaning member. Therefore, it is possible to prevent the dirt such as toner which has been removed from adhering to the endless belt, the fixing roller, the recording material, and/or the like again.

An image forming apparatus according to an embodiment of the present invention includes any of the foregoing fixing apparatuses.

With this configuration, it is possible to prevent the endless belt from being scratched due to sliding between the cleaning member and the endless belt, and also to prevent an increase in a load applied in the direction which hinders the rotation of the endless belt, so that slippage of the endless belt is prevented.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

The invention claimed is:

1. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the cleaning member is a scraper including a plate member having an edge being in contact with the surface of the endless belt so that the dirt adhered to the surface of the endless belt is removed, and the scraper includes:

a bending portion at which the plate member is bent;

a cleaning section which is a part of the plate member from the edge to the bending portion;

a supporting section which is a part of the plate member from the bending portion to another edge of the plate member, the supporting section being fixed to a housing of the fixing apparatus, and the scraper having, at the bending portion, an opening which cuts in the plate member in a direction intersecting a straight line made by the bending portion.

2. The image forming apparatus as set forth in claim 1, wherein:

the endless belt is suspended and supported by the fixing roller and at least one suspending roller;

the pressure member applies pressure against the fixing roller via the endless belt;

the unfixed toner image is fixed on the recording material in such a manner that the recording material on which the unfixed toner image is transferred is passed through a nip between the pressure member and an outer surface of the endless belt which outer surface is on a side not being in contact with the fixing roller; and the cleaning member is in contact with the outer surface of the endless belt.

3. The image forming apparatus as set forth in claim 1, wherein:

the scraper is made of metal.

4. The image forming apparatus as set forth in claim 1, wherein:

a surface of the scraper is coated with a coating made of fluororesin.

5. The image forming apparatus as set forth in claim 4, wherein:

the coating is made of a material different from a surface layer material for the surface of the endless belt which surface is in contact with the scraper.

6. The image forming apparatus as set forth in claim 1, further comprising:

a containing member, provided below the cleaning member, for storing the dirt that the cleaning member has removed from the endless belt.

7. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the endless belt is suspended and supported by a plurality of suspending rollers;

an outer surface of the endless belt is in contact with the fixing roller, the outer surface being on a side not being in contact with the plurality of suspending rollers; and the cleaning member is in contact with the outer surface of the endless belt.

8. The image forming apparatus as set forth in claim 7, wherein:

the outer surface of the endless belt is made of a same material as that for the surface of the fixing roller.

9. The image forming apparatus as set forth in claim 7, wherein:

the outer surface of the endless belt is made of a material having a lower toner releasability than that of the surface of the fixing roller.

10. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the cleaning member is a scraper including a plate member having an edge being in contact with the surface of the endless belt so that the dirt adhered to the surface of the endless belt is removed, and the scraper includes:

a plurality of bending portions at which the plate member is bent, the plurality of bending portions being parallel to each other;

a cleaning section which is a part of the plate member from the edge to the plurality of bending portions; and a supporting section which is a part of the plate member from the plurality of bending portions to another edge of the plate member, the supporting section being fixed to a housing of the fixing apparatus.

11. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the cleaning member is a scraper including a plate member having an edge being in contact with the surface of the endless belt so that the dirt adhered to the surface of the endless belt is removed, a plurality of said scrapers are arranged in such a manner that the plurality of said scrapers are in contact with the endless belt in order along a rotational direction of the endless belt, and the scrapers being in contact with the endless belt at more downstream contacting points in the rotational direction of the endless belt are pressed against the endless belt with greater pushed amounts, each of the pushed amounts being a distance for which the endless belt is pushed down at the respective contacting point at which the respective scraper is pressed against the endless belt.

12. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the cleaning member is a scraper including a plate member having an edge being in contact with the surface of the endless belt so that the dirt adhered to the surface of the endless belt is removed, and a contacting angle is greater than 90°, the contacting angle being an angle made by (i) a part of the surface of the endless belt which part extends, toward an upstream of the rotational direction of the endless belt, from a contacting point at which the endless belt and the scraper are in contact with each other and (ii) a surface of the scraper which surface faces the upstream of the rotational direction of the endless belt and includes said contacting point.

13. The image forming apparatus as set forth in claim 12, wherein:

the contacting angle is within a range of 135° or greater but not greater than 165°.

14. An image forming apparatus comprising a fixing apparatus that fixes an unfixed toner image on a recording material on which the unfixed toner image has been transferred, said fixing apparatus comprising:

a fixing roller;

a pressure member for applying pressure against the fixing roller, wherein the recording material is passed through a nip between the fixing roller and the pressure member to fix the unfixed toner image on the recording material;

an endless belt which is rotatably supported and heats the fixing roller by being in contact with a surface of the fixing roller; and heating means for heating the endless belt, said fixing apparatus further comprising;

a cleaning member for removing dirt adhered to a surface of the endless belt by being in contact with the surface of the endless belt in a region where the endless belt is not supported, wherein:

the cleaning member is a scraper including a plate member having an edge being in contact with the surface of the endless belt so that the dirt adhered to the surface of the endless belt is removed, and a pushed amount for which the scraper pushes down the endless belt is 0.3 mm or more but not more than 1 mm, the pushed amount being a distance for which the endless belt is pushed down at a contacting point at which the scraper is pressed against the endless belt.

* * * * *